US012378851B2

(12) United States Patent
Van Clief et al.

(10) Patent No.: US 12,378,851 B2
(45) Date of Patent: Aug. 5, 2025

(54) METHOD AND SYSTEM FOR PRODUCING WELL FLUIDS

(71) Applicant: Liquid Rod Lift, LLC, Houston, TX (US)

(72) Inventors: Rockni R. Van Clief, Houston, TX (US); Christian Atilano, Houston, TX (US); Caleb R. Newman, Tomball, TX (US); James R. Savage, Houston, TX (US); Henry Joe Jordan, Jr., Willis, TX (US)

(73) Assignee: Liquid Rod Lift, LLC, Houston, TX (US)

( * ) Notice: Subject to any disclaimer, the term of this patent is extended or adjusted under 35 U.S.C. 154(b) by 0 days.

(21) Appl. No.: 18/117,819

(22) Filed: Mar. 6, 2023

(65) Prior Publication Data

US 2023/0279752 A1 Sep. 7, 2023

Related U.S. Application Data

(60) Provisional application No. 63/317,494, filed on Mar. 7, 2022.

(51) Int. Cl.
*E21B 43/12* (2006.01)

(52) U.S. Cl.
CPC ..... *E21B 43/121* (2013.01)

(58) Field of Classification Search
CPC ..... E21B 43/16
See application file for complete search history.

(56) References Cited

U.S. PATENT DOCUMENTS 731,241 A 6/1903 Steiner
2,277,306 A 3/1942 Coffey
(Continued)

FOREIGN PATENT DOCUMENTS

WO 2010002841 A2 1/2010
WO 2011069517 A1 6/2011
WO 2013086623 A1 6/2013

OTHER PUBLICATIONS

International Search Report and Written Opinion dated Nov. 30, 2020 for Application No. PCT/US2020/047980.
(Continued)

*Primary Examiner* — William D Hutton, Jr.
*Assistant Examiner* — Avi T Skaist
(74) *Attorney, Agent, or Firm* — Patterson + Sheridan, LLP

(57) ABSTRACT

A pump includes a drive chamber with a drive piston and a production chamber with a production piston. The drive piston is coupled to the production piston. The pump further includes a passage in fluidic communication with the drive piston and a port fluidically coupling the passage with the production chamber. In operation, a first pressure is applied to fluid in the passage, thereby moving the drive piston. Then a second higher pressure is applied to fluid in the passage, thereby opening a valve associated with the port. In an example operation, fluid flows from the passage into the production chamber, and flushes gas out of the production chamber, thereby alleviating gas-locking. In another example operation, fluid including a treatment chemical flows from the passage into the production chamber. A surface equipment package includes a controller configured to monitor and control operation of the pump.

18 Claims, 12 Drawing Sheets

(56) References Cited

U.S. PATENT DOCUMENTS

| | | | |
|---|---|---|---|
| 2,311,212 | A | 2/1943 | Coberly |
| 2,420,151 | A | 5/1947 | Renouf et al. |
| 2,631,541 | A | 3/1953 | Dempsey |
| 2,983,227 | A | 5/1961 | English |
| 3,123,007 | A | 3/1964 | Orr |
| 3,222,994 | A | 12/1965 | English |
| 3,912,420 | A | 10/1975 | Gault |
| 3,918,845 | A | 11/1975 | Heard |
| 4,013,385 | A | 3/1977 | Peterson |
| 4,118,154 | A | 10/1978 | Roeder |
| 4,403,919 | A | 9/1983 | Stanton et al. |
| 4,405,291 | A | 9/1983 | Canalizo |
| 4,490,095 | A | 12/1984 | Soderberg |
| 4,551,075 | A | 11/1985 | Canalizo |
| 4,611,974 | A | 9/1986 | Holland |
| 4,616,981 | A | 10/1986 | Simmons et al. |
| 4,861,239 | A | 8/1989 | Simmons et al. |
| 5,494,102 | A | 2/1996 | Schulte |
| 5,785,500 | A | 7/1998 | Leniek |
| 6,131,660 | A | 10/2000 | Stuebinger et al. |
| 6,193,476 | B1 | 2/2001 | Sweeney |
| 6,598,681 | B1 | 7/2003 | Berry |
| 6,817,409 | B2 | 11/2004 | Howard |
| 7,445,435 | B2 | 11/2008 | Howard |
| 7,775,776 | B2 | 8/2010 | Bolding |
| 7,874,367 | B2 | 1/2011 | Simmons |
| 7,927,083 | B2 | 4/2011 | Simmons |
| 7,967,578 | B2 | 6/2011 | McNichol et al. |
| 7,984,756 | B2 | 7/2011 | Dowling et al. |
| 8,011,901 | B2 | 9/2011 | Duncan |
| 8,360,751 | B2 | 1/2013 | Duncan |
| 8,454,325 | B2 | 6/2013 | Fisher et al. |
| 8,523,542 | B2 | 9/2013 | Hofstatter |
| 8,535,017 | B2 | 9/2013 | McNichol et al. |
| 8,573,309 | B2 | 11/2013 | Simmons |
| 8,932,030 | B2 | 1/2015 | McNichol et al. |
| 8,991,504 | B2 | 3/2015 | Hansen |
| 10,280,727 | B2 | 5/2019 | Saponja et al. |
| 11,396,798 | B2 | 7/2022 | Jordan, Jr. et al. |
| 11,634,975 | B2 | 4/2023 | Jordan, Jr. |
| 2007/0039740 | A1* | 2/2007 | Bolding ..... F04B 9/107 166/372 |
| 2009/0183870 | A1 | 7/2009 | Leitch |
| 2009/0321084 | A1 | 12/2009 | Simmons |
| 2014/0341755 | A1 | 11/2014 | Laing et al. |
| 2015/0267519 | A1 | 9/2015 | Saponja et al. |
| 2016/0102536 | A1 | 4/2016 | Knoeller |
| 2016/0290111 | A1 | 10/2016 | Patel |
| 2018/0283155 | A1 | 10/2018 | Saponja et al. |
| 2019/0048695 | A1 | 2/2019 | Hansen et al. |
| 2019/0120791 | A1 | 4/2019 | Al-Gouhi et al. |
| 2019/0195059 | A1 | 6/2019 | Hrupp |
| 2021/0062628 | A1* | 3/2021 | Jordan, Jr. ..... F04B 9/113 |

OTHER PUBLICATIONS

International Invitation to Pay Additional Fees and, Where Applicable, Protest Fee dated Dec. 4, 2020 for Application No. PCT/US2020/047983.

International Search Report and Written Opinion dated Feb. 2, 2021 for Application No. PCT/US20/47983.

Heal Systems LLP—"Heal System: Where does the flow go?" www.healsystems.com, 2018, 1 page.

Langbauer, C., et al.—"Hydraulic Concentric Tubular Pumping System for Lifting Oil in EOR Completions," SPE-190344-MS, paper prepared for presentation at the SPE-EOR Conference at Oil and Gas West Asia held in Muscat, Oman, Mar. 26-28, 2018, 12 pages.

Petrowiki—"Hydraulic pumping," https://petrowiki.org/Hydraulic_pumping, last modified on Feb. 4, 2016, 16 pages.

Presley, Jennifer—"Selecting the Right Technology is Vital in Horizontal Wells," May 2012 Exclusive Story, the American Oil & Gas Reporter, Feb. 18, 2020, 7 pages.

* cited by examiner

METHOD AND SYSTEM FOR PRODUCING WELL FLUIDS

BACKGROUND

Field

Embodiments of the present disclosure generally relate to a pump that can be installed in a wellbore, and methods of using a pump to assist in the production of fluids from a wellbore.

Description of the Related Art

The production of fluids from a wellbore may involve using a downhole pump that is installed within the wellbore. Some types of downhole pump are driven by an electric motor located within the wellbore. Such pumps typically contain many successive pump stages, each stage connected to central shaft that is rotated at high speed by the electric motor. Such pumps, therefore, are relatively long and thus may be unsuitable for use in wellbores that are curved because the high speed rotation of a curved shaft may cause issues with fatigue and wear. Additionally, the electric motors of such pumps are prone to suffer issues with the longevity of electrical insulation and with the effective dissipation of heat during operation.

Other types of downhole pump are driven by a mechanical linkage connected to a driver at surface. One example is a so-called rod lift pump that has a rod extending from surface into the wellbore and down to the pump. The rod is manipulated by a pumpjack at surface such that the rod reciprocates axially. Downhole, the rod is connected to a pump, and the reciprocal motion of the rod causes the pump to lift an incremental volume of fluid with each reciprocation. Such pump systems may also be unsuitable for curved wellbores because wellbore curvature causes the rods to rub against the wellbore tubulars, leading to wear of the rods and wear of the tubulars. Additionally, the friction between the rods and the wellbore tubulars is a source of inefficiency that limits the depth and deviation angle of wellbores at which such pumps may be effectively operated. Therefore, such pumps may be unsuitable for installation at, or close to, a producing zone of a highly deviated, or horizontal, wellbore.

The operation of some pumps may be adversely affected by the deposition of substances such as scale, wax, and/or asphaltenes. Additionally, tubulars, pumps, and/or other equipment in a well may be subject to corrosion.

There is a need for improved pumping systems that can be utilized in deep, deviated, and/or horizontal wellbores. There is a need for improved pumping systems that can be controlled to operate efficiently. There is a need for improved pumping systems that can facilitate the implementation of measures to combat corrosion and/or the deposition of scale, wax, and/or asphaltenes.

SUMMARY

The present disclosure generally relates to a pump for use in a wellbore, and to methods of operating such a pump to produce fluids from the wellbore.

In one embodiment, a pump includes a drive chamber, a production chamber having a fluid inlet configured to permit entry of fluids external to the pump into the production chamber, and a piston assembly, The piston assembly includes a drive piston axially movable within the drive chamber coupled to a production piston axially movable within the production chamber. The pump further includes a passage in fluidic communication with the drive piston, and a port fluidically coupling the passage with fluids external to the pump.

In another embodiment, a pump includes a drive chamber, a production chamber having a fluid inlet configured to permit entry of fluids external to the pump into the production chamber, and a piston assembly. The piston assembly includes a drive piston axially movable within the drive chamber coupled to a production piston axially movable within the production chamber. The pump further includes a passage in fluidic communication with the drive piston, and a port fluidically coupling the passage with the production chamber.

In another embodiment, a method of operating a pump in a wellbore includes applying a first pressure to a fluid, thereby moving a drive piston in a first direction within a drive chamber and moving a production piston in the first direction within a production chamber. The method thereafter includes applying a second pressure to the fluid, the second pressure greater than the first pressure, and injecting the fluid into the production chamber through a port.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure relates to a system including a pump for installation and use in a wellbore. The pump is driven by the successive application and release of hydraulic pressure via a power fluid. The present disclosure relates also to methods of operating such a pump to produce fluids from a wellbore.

Figure 1:
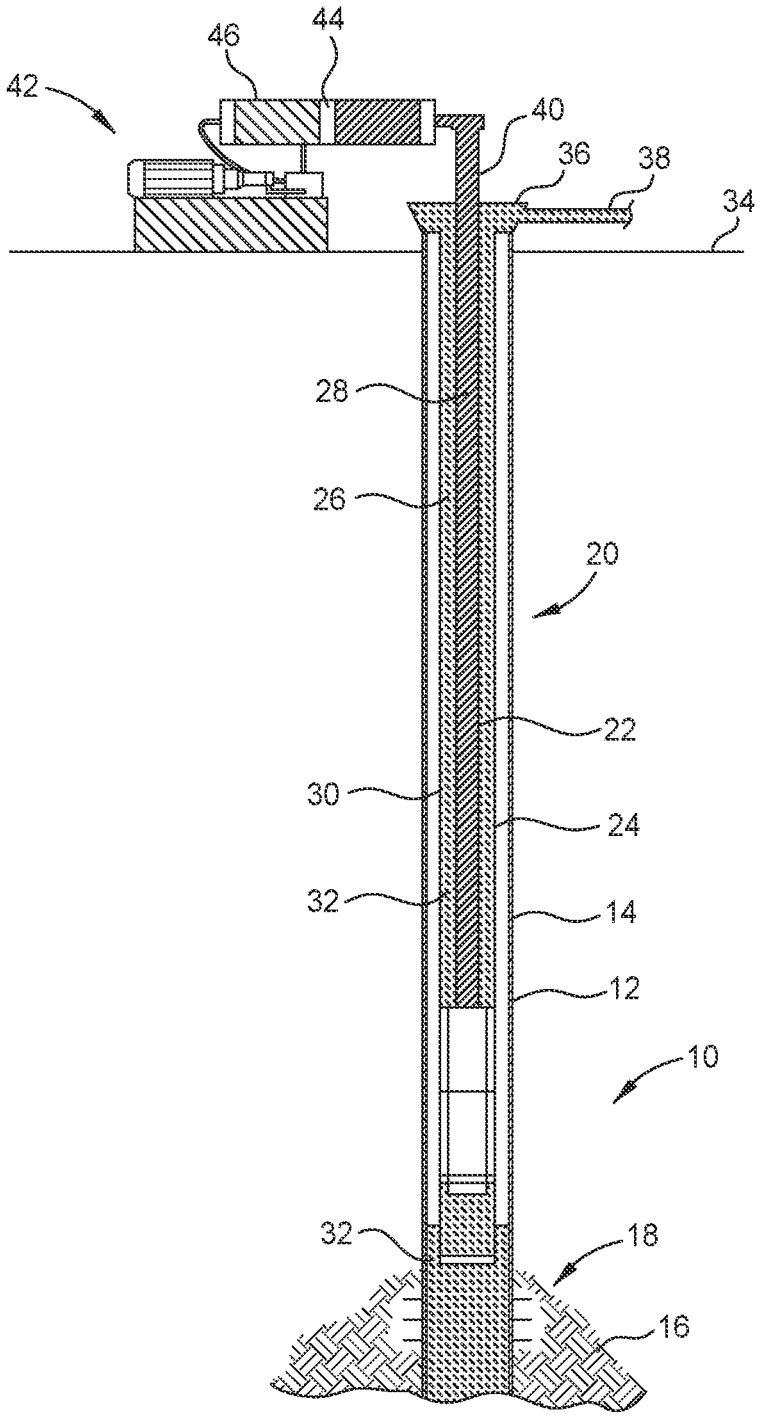
FIG. 1 is an overview of a system that includes a pump installed in a wellbore.

FIG. 1 is a schematic overview of a system that includes a pump 10 installed in a wellbore 12. For clarity, the wellbore 12 is shown as being vertical, but the wellbore 12 may be deviated, curved, or horizontal. The wellbore 12 is lined with a casing 14, and penetrates a geological formation 16. Reservoir fluid 32 of the geological formation 16 enters the wellbore 12 at a zone of fluid influx 18. A pump 10 is located in a lower part of the wellbore 12. The pump 10 may be located in a vertical, deviated, curved, or horizontal part of the wellbore 12.

The pump 10 is coupled to a tubing string 20. In the illustrated embodiment, the tubing string 20 includes an inner tubular 22 and an outer tubular 24. In the illustrated embodiment, the inner tubular 22 serves as a conduit (termed a "power fluid conduit" 26) for a power fluid 28, and the outer tubular 24 serves as a conduit (termed a "produced fluid conduit" 30) for reservoir fluid 32 produced from the geological formation 16. In some embodiments, the inner tubular 22 may be a produced fluid conduit 30, and the outer tubular 24 may be a power fluid conduit 26. In some embodiments, the power fluid conduit 26 may be positioned side-by-side with the produced fluid conduit 30. In some embodiments, the power fluid conduit 26 may be a tubular having a smaller diameter than the produced fluid conduit 30. In some embodiments, the power fluid conduit 26 may be a capillary line.

In some embodiments, the tubing string 20 may be a single string of tubulars. The single string of tubulars may be a power fluid conduit 26, and an annulus between the tubing string 20 and the casing 14 may be a produced fluid conduit 30. Alternatively, the single string of tubulars may be a produced fluid conduit 30, and the annulus between the tubing string 20 and the casing 14 may be a power fluid conduit 26.

At the surface 34, a wellhead 36 includes an outlet 38 for the fluids that are produced from the geological formation 16. The wellhead 36 has an inlet 40 for the power fluid 28. The power fluid inlet 40 is connected to a pulsar unit 42. The pulsar unit 42 includes a piston 44 in a cylinder 46. The piston 44 is operated to reciprocate in the cylinder 46 so as to repeatedly apply then release a pressure on the power fluid 28 that is contained in the power fluid conduit 26.

In some embodiments, the pressure applied on the power fluid 28 by the piston 44 may be 500 psi (approximately 34.5 bar) or greater. In some embodiments, the pressure applied on the power fluid 28 by the piston 44 may be 1,000 psi (approximately 69 bar) or greater. In some embodiments, the pressure applied on the power fluid 28 by the piston 44 may be 2,000 psi (approximately 138 bar) or greater. In some embodiments, the pressure applied on the power fluid 28 by the piston 44 may be 3,000 psi (approximately 207 bar) or greater. In some embodiments, the pressure applied on the power fluid 28 by the piston 44 may be from 4,000 to 5,000 psi (approximately 276 to 345 bar).

In some embodiments, the release of the pressure on the power fluid 28 may involve causing or allowing the magnitude of pressure applied on the power fluid 28 by the piston 44 to decrease to a value that is substantially atmospheric pressure. In some embodiments, the release of the pressure on the power fluid 28 may involve causing or allowing the magnitude of pressure applied on the power fluid 28 by the piston 44 to decrease to a value that is greater than atmospheric pressure. In some embodiments, the release of the pressure on the power fluid 28 may involve causing or allowing the magnitude of pressure applied on the power fluid 28 by the piston 44 to decrease to a value that is less than atmospheric pressure.

In operation, the repeated application then release of pressure exerted by the pulsar unit 42 on the power fluid 28 in the power fluid conduit 26 drives the pump 10. Reservoir fluid 32 from the geological formation 16 moves into the wellbore 12. Reservoir fluid 32 in the wellbore 12 becomes drawn into the pump 10, then expelled from the pump 10 into the produced fluid conduit 30. Continued operation of the pump 10 causes the reservoir fluid 32 to move up the produced fluid conduit 30 to the wellhead 36, and then out of the outlet 38.

Figure 2:
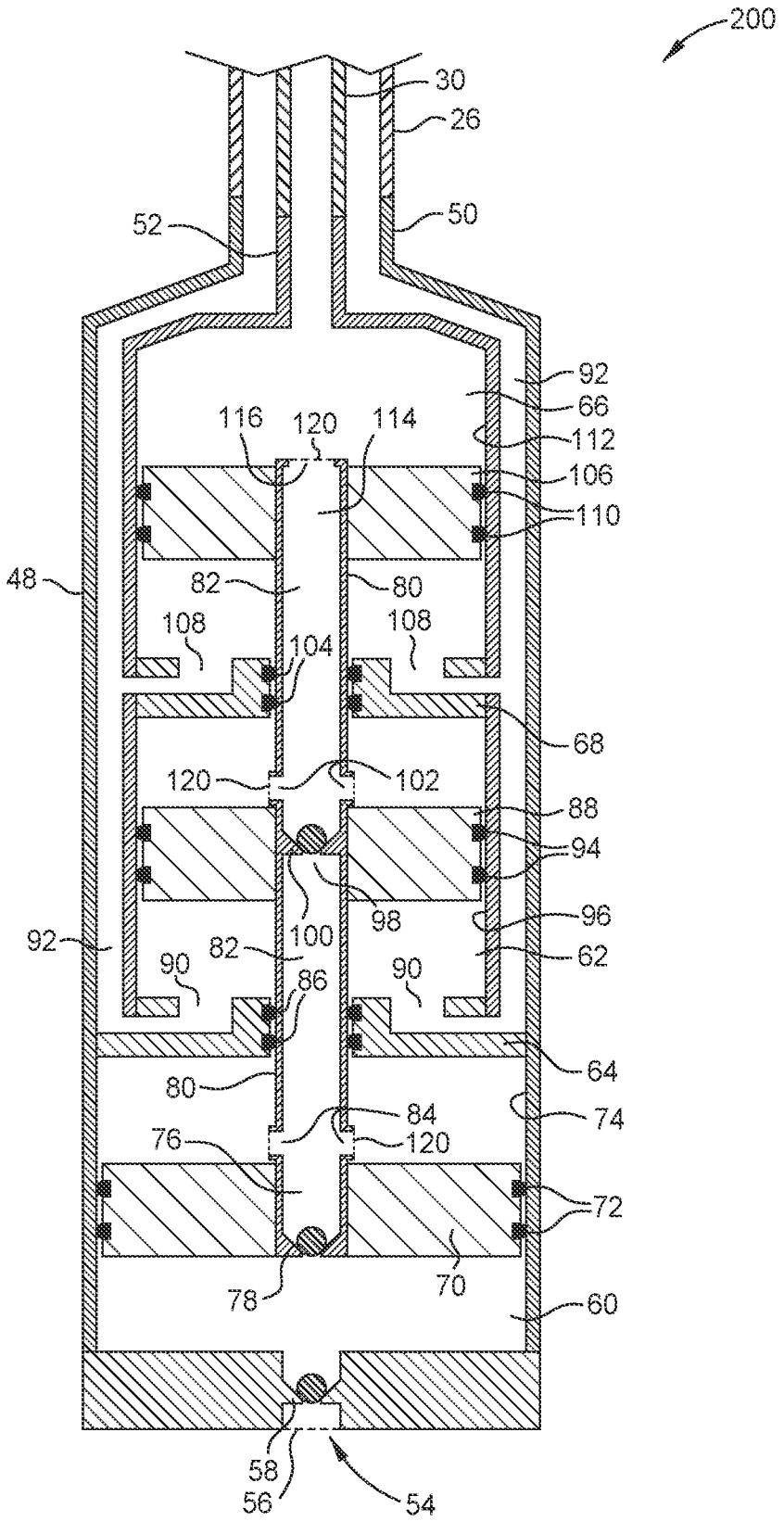
FIG. 2 is a schematic illustration of an embodiment of a pump.

FIG. 2 is a schematic longitudinal cross-sectional view of a pump 200 that is suitable for installation and operation in a wellbore, such as wellbore 12. Pump 200 is an example of pump 10 from FIG. 1. The pump 200 includes a housing 48. In some embodiments, the housing 48 may be tubular in shape. The housing 48 includes a connection 50 to a power fluid conduit 26. The housing 48 includes a connection 52 to a produced fluid conduit 30. In the embodiment shown in FIG. 2, the produced fluid conduit 30 is internal to the power fluid conduit 26. The housing 48 includes a reservoir fluid inlet 54. In some embodiments, the housing 48 may include more than one reservoir fluid inlet 54. In some embodiments, the reservoir fluid inlet 54 may include a filter 56, such as a screen. The filter 56 may be configured to allow fluids to pass through the reservoir fluid inlet 54 but inhibit the passage of solid particles. In some embodiments, the filter 56 may include a screen or mesh that is mounted on the outside of the housing 48 and across the reservoir fluid inlet 54. In some embodiments, the filter 56 may include a screen or mesh that is mounted on the inside of the housing 48 and across the reservoir fluid inlet 54. In some embodiments, the filter 56 may include a screen or mesh that is inserted into the reservoir fluid inlet 54. In some embodiments, the reservoir fluid inlet 54 may include one or more narrow width opening through the wall of the housing 48 which may also serve as the filter 56. In some embodiments, the filter 56 may be omitted.

In some embodiments, the reservoir fluid inlet 54 may include a standing valve 58. When present, the standing valve 58 is configured to allow fluids to pass through the reservoir fluid inlet 54 into the pump 200, but inhibit the passage of fluids out of the pump 200 through the reservoir fluid inlet 54. In some embodiments, the reservoir fluid inlet 54 may include more than one standing valve 58. In some embodiments, the plurality of standing valves 58 may be arranged in series such that fluid entering the pump 10 passes through each standing valve 58. In some embodiments, the standing valve 58 may be omitted, such that fluids may pass through the reservoir fluid inlet 54 into and out of the pump 200.

The housing 48 includes a production chamber 60. In some embodiments, the housing 48 includes a reset chamber 62 that is separated from the production chamber 60 by a first bulkhead 64. In some embodiments, the housing 48 includes a drive chamber 66. The drive chamber 66 is separated from the reset chamber 62 by a second bulkhead 68. In some embodiments, the reset chamber 62 may be omitted, and the housing 48 includes a drive chamber 66 separated from the production chamber 60 by the first bulkhead 64. In some embodiments, the housing 48, bulkheads 64, 68, and chambers 60, 62, 66 are modular such that the pump 200 may be configured with more than one drive chamber 66. In some embodiments, the housing 48, bulkheads 64, 68, and chambers 60, 62, 66 are modular such that the pump 200 may be configured with more than one reset chamber 62. In some embodiments, the housing 48, bulkheads 64, 68, and chambers 60, 62, 66 are modular such that the pump 200 may be configured with more than one production chamber 60.

A production piston 70 is disposed in the production chamber 60. The production piston 70 separates the production chamber 60 into upper and lower portions, and be axially movable within the production chamber 60 such that movement of the production piston 70 causes a volume of the upper portion of the production chamber 60 and a volume of the lower portion of the production chamber 60 to change. Thus, movement of the production piston 70 in a first direction causes the volume of the upper portion of the production chamber 60 to decrease and the volume of the lower portion of the production chamber 60 to correspondingly increase. Similarly, movement of the production piston 70 in a second direction opposite to the first direction causes the volume of the upper portion of the production chamber 60 to increase and the volume of the lower portion of the production chamber 60 to correspondingly decrease.

The production piston 70 includes a seal 72 in contact with an inner wall 74 of the production chamber 60. The production piston 70 includes a bore 76 that fluidically connects the lower portion of the production chamber 60 and the upper portion of the production chamber 60. A first traveling valve 78 is associated with the bore 76. The first traveling valve 78 is attached to the bore 76 of the production piston 70 such that it moves with the production piston 70. The first traveling valve 78 is configured to allow passage of fluid from the lower portion of the production chamber 60 to the upper portion of the production chamber 60, but inhibit the passage of fluid from the upper portion of the production chamber 60 to the lower portion of the production chamber 60.

The production piston 70 is coupled to a tube, such as transfer tube 80. The transfer tube 80 is axially movable with the production piston 70. In some embodiments, the production piston 70 is mounted around the transfer tube 80. In some embodiments, the production piston 70 is mounted to the transfer tube 80 such that a bore 82 of the transfer tube 80 is fluidically connected to the bore 76 of the production piston 70. The assembly of the transfer tube 80 and the production piston 70 includes a port 84 to allow fluid to transfer between the upper portion of the production chamber 60 and the bore 76 of the production piston 70 and/or the bore 82 of the transfer tube 80. The port 84 is located above the first traveling valve 78. In some embodiments, a filter 120 is associated with the port 84. The filter 120 is configured to allow fluids to pass through the port 84, but inhibit the passage of solid particles through the port 84. In some embodiments, the filter 120 includes a screen or mesh that is mounted on the outside of the transfer tube 80 and across the port 84. In some embodiments, the filter 120 includes a screen or mesh that is mounted on the inside of the transfer tube 80 and across the port 84. In some embodiments, the filter 120 includes a screen or mesh that is inserted into the port 84. In some embodiments, the port 84 includes one or more narrow width opening through the wall of the transfer tube 80 which also serves as the filter 120. In some embodiments, the filter 120 may be omitted. In some embodiments, the bore 82 of the transfer tube 80 is fluidically connected to the bore 76 of the production piston 70 via the upper portion of the production chamber 60.

The upper portion of the production chamber 60 is bounded by the first bulkhead 64. The transfer tube 80 extends through the first bulkhead 64. One or more seals 86 prevent fluid from leaking through the first bulkhead 64 around the transfer tube 80. In embodiments in which the housing 48 has a reset chamber 62, the first bulkhead 64 forms a lower bound of the reset chamber 62. A reset piston 88 is disposed in the reset chamber 62. The reset piston 88 separates the reset chamber 62 into upper and lower portions, and is axially movable within the reset chamber 62 such that movement of the reset piston 88 causes a volume of the upper portion of the reset chamber 62 and a volume of the lower portion of the reset chamber 62 to change. Thus, movement of the reset piston 88 in a first direction causes the volume of the upper portion of the reset chamber 62 to decrease and the volume of the lower portion of the reset chamber 62 to correspondingly increase. Similarly, movement of the reset piston 88 in a second direction opposite to the first direction causes the volume of the upper portion of the reset chamber 62 to increase and the volume of the lower portion of the reset chamber 62 to correspondingly decrease.

The lower portion of the reset chamber 62 has a port 90 that fluidically connects the lower portion of the reset chamber 62 with a power fluid passage 92. The power fluid passage 92 is fluidically connected with the connection 50 to the power fluid conduit 26. In some embodiments, the power fluid passage 92 is an annular passage. In some embodiments, the power fluid passage 92 is located to one side of the housing 48.

The reset piston 88 includes a seal 94 in contact with an inner wall 96 of the reset chamber 62. The reset piston 88 includes a bore 98 from an upper side of the reset piston 88 to a lower side of the reset piston 88. The reset piston 88 is coupled to the transfer tube 80, and is movable with the transfer tube 80. In some embodiments, the transfer tube 80 extends through the bore 98 of the reset piston 88. In some embodiments, the reset piston 88 is mounted to the transfer tube 80 such that the bore 82 of the transfer tube 80 is fluidically connected with the bore 98 of the reset piston 88. A second traveling valve 100 is associated with the assembly of the reset piston 88 and the transfer tube 80. The second traveling valve 100 is movable with the reset piston 88. The second traveling valve 100 is configured to allow passage of fluid within the transfer tube 80 from below the second traveling valve 100 to above the second traveling valve 100, but inhibit the passage of fluid from above the second traveling valve 100 to below the second traveling valve 100.

The transfer tube 80 extends beyond an upper end of the reset piston 88. In some embodiments, the assembly of the transfer tube 80 and the reset piston 88 includes a port 102 to allow fluid to transfer between the upper portion of the reset chamber 62 and the bore 98 of the reset piston 88 and/or the bore 82 of the transfer tube 80. The port 102 is located above the second traveling valve 100. In some embodiments, a filter 120 is associated with the port 102. The filter 120 is configured to allow fluids to pass through the port 102, but inhibit the passage of solid particles through the port 102. In some embodiments, the filter 120 includes a screen or mesh that is mounted on the outside of the transfer tube 80 and across the port 102. In some embodiments, the filter 120 includes a screen or mesh that is mounted on the inside of the transfer tube 80 and across the port 102. In some embodiments, the filter 120 includes a screen or mesh that is inserted into the port 102. In some embodiments, the port 102 includes one or more narrow width opening through the wall of the transfer tube 80 which also serves as the filter 120. In some embodiments, the filter 120 is omitted. In some embodiments, the bore 82 of the transfer tube 80 above the reset piston 88 is fluidically connected to the bore 98 of the reset piston 88 via the upper portion of the reset chamber 62.

The upper portion of the reset chamber 62 is bounded by the second bulkhead 68. The transfer tube 80 extends through the second bulkhead 68. One or more seals 104 prevent fluid from leaking through the second bulkhead 68 around the transfer tube 80. In embodiments in which the housing 48 includes a drive chamber 66, the second bulkhead 68 forms a lower bound of the drive chamber 66. A drive piston 106 is disposed in the drive chamber 66. The drive piston 106 separates the drive chamber 66 into upper and lower portions, and is axially movable within the drive chamber 66 such that movement of the drive piston 106 causes a volume of the upper portion of the drive chamber 66 and a volume of the lower portion of the drive chamber 66 to change. Thus, movement of the drive piston 106 in a first direction causes the volume of the upper portion of the drive chamber 66 to decrease and the volume of the lower portion of the drive chamber 66 to correspondingly increase. Similarly, movement of the drive piston 106 in a second direction opposite to the first direction causes the volume of the upper portion of the drive chamber 66 to increase and the volume of the lower portion of the drive chamber 66 to correspondingly decrease. The lower portion of the drive chamber 66 includes a port 108 that fluidically connects the lower portion of the drive chamber 66 with the power fluid passage 92.

The drive piston 106 includes a seal 110 in contact with an inner wall 112 of the drive chamber 66. The drive piston 106 includes a bore 114 from an upper side of the drive piston 106 to a lower side of the drive piston 106. The drive piston 106 is coupled to the transfer tube 80, and is movable with the transfer tube 80. In some embodiments, the transfer tube 80 extends through the bore 114 of the drive piston 106. In some embodiments, the drive piston 106 is mounted to the transfer tube 80 such that the bore 82 of the transfer tube 80 is fluidically connected with the bore 114 of the drive piston 106. A port 116 allows fluid communication between the upper portion of the drive chamber 66 and the bore 82 of the transfer tube 80. The upper portion of the drive chamber 66 is fluidically connected with the connection 52 to the produced fluid conduit 30. In some embodiments, a filter 120 is associated with the port 116. The filter 120 is configured to allow fluids to pass through the port 116, but inhibit the passage of solid particles through the port 116. In some embodiments, the filter 120 includes a screen or mesh that is mounted on the outside of the transfer tube 80 and across the port 116. In some embodiments, the filter 120 includes a screen or mesh that is mounted on the inside of the transfer tube 80 and across the port 116. In some embodiments, the filter 120 includes a screen or mesh that is inserted into the port 116. In some embodiments, the port 116 includes one or more narrow width opening through the wall of the transfer tube 80 that also serves as the filter 120. In some embodiments, the filter 120 is omitted.

In some embodiments, the pump 200 is modular, such that the pump 200 includes one or more drive chamber 66, each drive chamber 66 having a drive piston 106. In some embodiments, the pump 200 includes one or more reset chamber 62, each reset chamber 62 having a reset piston 88. In some embodiments, the pump 200 includes one or more production chamber 60, each production chamber 60 having a production piston 70. The drive piston 106, production piston 70, and transfer tube 80 forms a piston assembly. In some embodiments, the piston assembly includes the reset piston 88. In some embodiments, the piston assembly includes the first traveling valve 78. In some embodiments, the piston assembly includes the second traveling valve 100. In some embodiments, the piston assembly includes additional pistons according to the modular configurations of the pump 200. In operation, the piston assembly moves axially as a unit within the pump 200.

Figure 3:
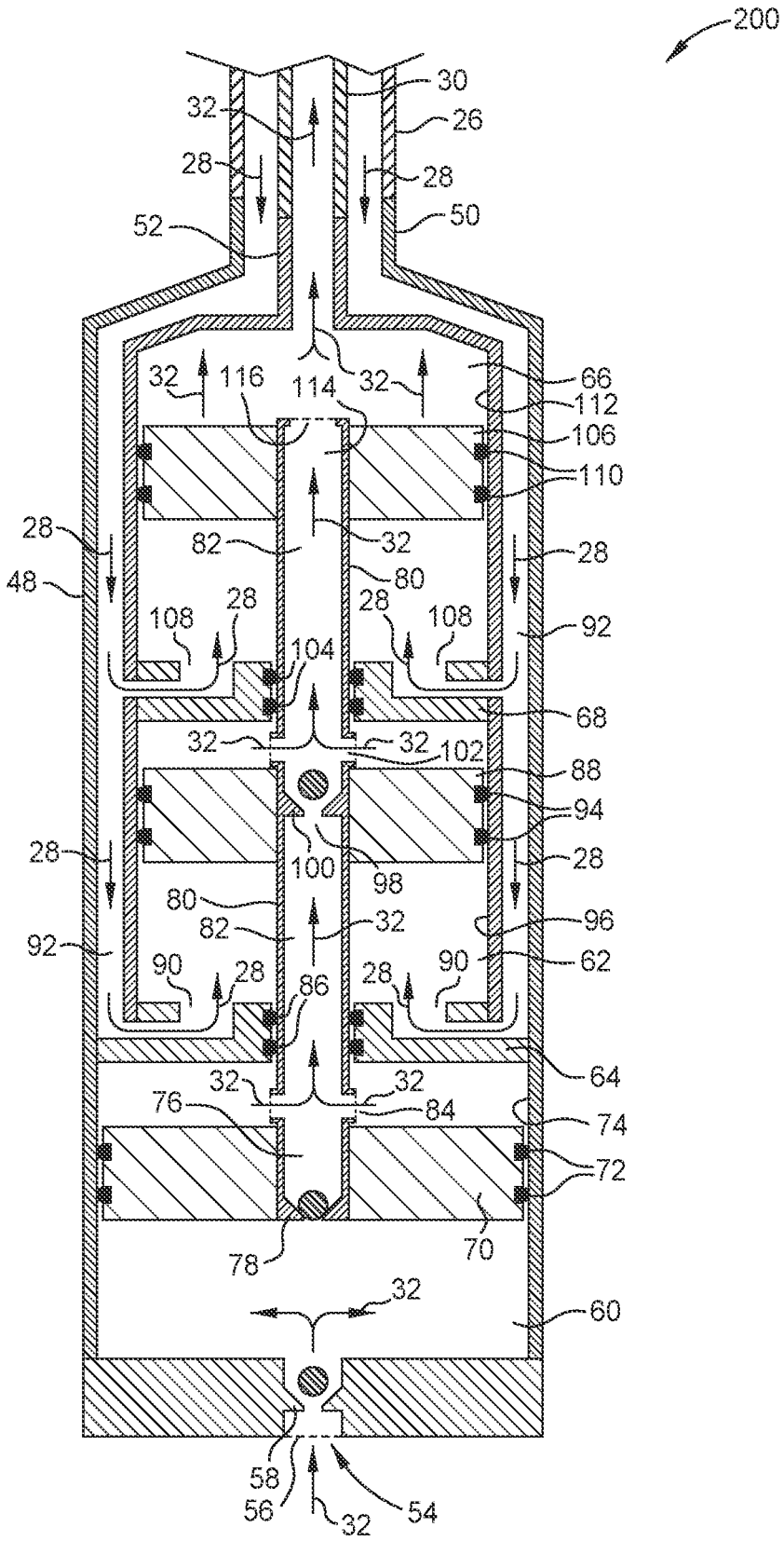
FIG. 3 is a schematic illustration of the embodiment of FIG. 2 during a first phase of operation.
Figure 4:
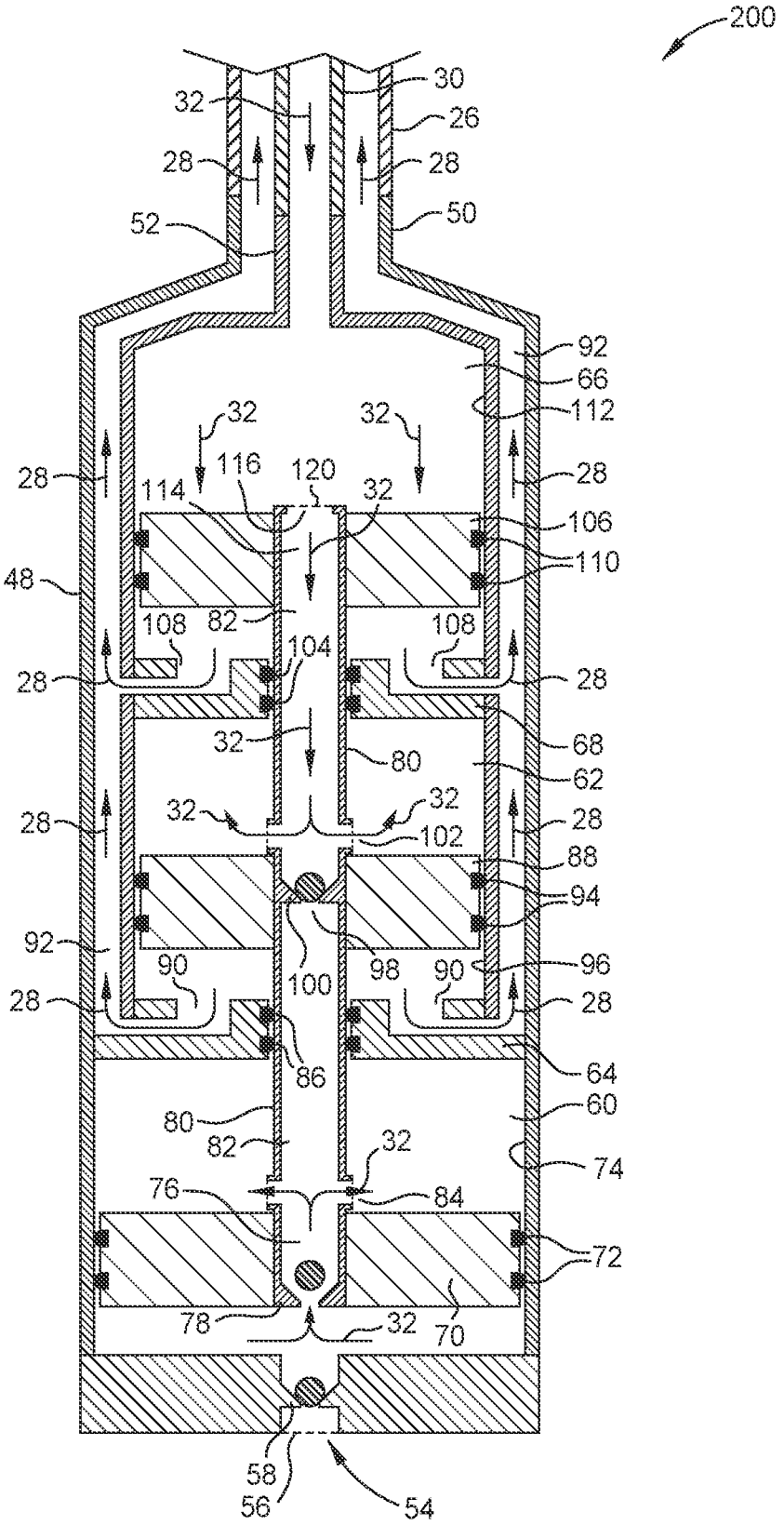
FIG. 4 is a schematic illustration of the embodiment of FIG. 2 during a second phase of operation.

FIGS. 3 and 4 are schematic longitudinal cross sections illustrating the operation of the pump 200 depicted in FIG. 2, and may be referred to in combination with FIG. 1. The pump 200 is installed in a wellbore 12, and is connected to a power fluid conduit 26 and a produced fluid conduit 30. The pump 200 contains power fluid 28 in the power fluid passage 92, in the lower portion of the reset chamber 62, and in the lower portion of the drive chamber 66. The power fluid conduit 26 contains power fluid 28. The power fluid 28 substantially fills the power fluid conduit 26 from the pump 200 to the surface 34. The power fluid 28 in the power fluid conduit 26 exerts a hydrostatic pressure ("hydrostatic head") on the power fluid 28 in the pump 200.

The pump 200 contains reservoir fluid 32 in the production chamber 60, in the upper portion of the reset chamber 62, in the upper portion of the drive chamber 66, and in the transfer tube 80. During operation of the pump 200, the produced fluid conduit 30 contains reservoir fluid 32. The column of fluid in the produced fluid conduit 30 exerts a hydrostatic pressure ("hydrostatic head") on the reservoir fluid 32 in the pump 10.

In some embodiments, the power fluid 28 may have a density that is less than the density of the reservoir fluid 32. In some embodiments, the power fluid 28 may have a density that is substantially the same as the density of the reservoir fluid 32. In some embodiments, the power fluid 28 may include a hydrocarbon liquid. In some embodiments, the power fluid 28 may include water.

FIG. 3 shows the pump 200 in operation during a first phase. The first phase may be referred to as a production stroke. For the pump 200 of FIG. 2, the production stroke is an up stroke of the pistons 70, 88, and 106. During a production stroke, a pressure is applied to the power fluid 28 in the power fluid conduit 26. The pressure is applied by pulsar unit 42 at the surface 34, and the power fluid 28 in the power fluid conduit 26 communicates the applied pressure to the pump 200. The power fluid 28 communicate the applied pressure to the power fluid 28 contained in the power fluid passage 92, and hence to the power fluid 28 in the lower portion of the reset chamber 62 through the port 90 and to the power fluid 28 in the lower portion of the drive chamber 66 through the port 108. Thus, the power fluid 28 in the power fluid passage 92, in the lower portion of the reset chamber 62, and in the lower portion of the drive chamber 66 experiences a pressure that is substantially equal to the magnitude of the pressure applied at surface 34 plus the hydrostatic head provided by the column of power fluid 28 in the power fluid conduit 26 from the surface 34 to the pump 200.

During a production stroke, a pressure may, or may not, be applied at the surface 34 to the reservoir fluid 32 in the produced fluid conduit 30. A pressure applied to the reservoir fluid 32 in the produced fluid conduit 30 may be in the form of a back pressure that is exerted due to the flow of reservoir fluid 32 through the wellhead outlet 38 and through associated valves and/or other restrictions. In some embodiments, effectively no pressure is applied at the surface 34 to the reservoir fluid 32 in the produced fluid conduit 30. In some embodiments, a pressure that is negligible in magnitude is applied at the surface 34 to the reservoir fluid 32 in the produced fluid conduit 30. When the reservoir fluid 32 is moving through the pump 200 and through the produced fluid conduit 30, the reservoir fluid 32 may experience a back pressure due to the flow of the reservoir fluid 32 through the pump 200 and through the produced fluid conduit 30. Thus, the reservoir fluid 32 contained within the upper portion of the drive chamber 66 and the upper portion of the reset chamber 62 experiences a pressure that is substantially equal to the magnitude of any pressure applied at surface 34 plus any flow-generated back pressure plus the hydrostatic head provided by the column of reservoir fluid 32 in the produced fluid conduit 30.

By appropriate selection of the composition and density of the power fluid 28, and appropriate selection of the magnitude of the pressure applied at the surface 34 to the column of power fluid 28 in the power fluid conduit 26, the pressure experienced by the power fluid 28 in the lower portion of the reset chamber 62 and in the lower portion of the drive chamber 66 is greater than the pressure experienced by the reservoir fluid 32 in the upper portion of the reset chamber 62 and in the upper portion of the drive chamber 66. Thus, the drive piston 106 and the reset piston 88 experience a pressure imbalance that urges the drive piston 106 and the reset piston 88 upward.

Upward movement of the drive piston 106 reduces the volume of the upper portion of the drive chamber 66, and therefore forces at least a portion of the reservoir fluid 32 contained in the drive chamber 66 out through the connection 52 to the produced fluid conduit 30 and into the produced fluid conduit 30. Reservoir fluid 32 that is already in the produced fluid conduit 30 is thus moved upwards, and, with reference back to FIG. 1, reservoir fluid 32 at an upper end of the produced fluid conduit 30 is moved through the wellhead 36 and out through the outlet 38.

Upward movement of the reset piston 88 reduces the volume of the upper portion of the reset chamber 62, and therefore forces at least a portion of the reservoir fluid 32 contained in the reset chamber 62 through the port 102 and into the transfer tube 80.

In embodiments in which the transfer tube 80 couples the drive piston 106 with the reset piston 88, the drive piston 106 and the reset piston 88 move in unison. As shown in FIG. 3, the transfer tube 80 couples the reset piston 88 with the production piston 70. Upward movement of the drive piston 106 coupled with the reset piston 88 causes upward movement of the production piston 70. Upward movement of the production piston 70 reduces the volume of the upper portion of the production chamber 60, and therefore forces at least a portion of the reservoir fluid 32 contained in the upper portion of the production chamber 60 through the port 84 and into the transfer tube 80.

Upward movement of the production piston 70 increases the volume of the lower portion of the production chamber 60, and therefore reduces the pressure of the reservoir fluid 32 contained within the lower portion of the production chamber 60. Since the pump 200 is in a wellbore 12, there is reservoir fluid 32 in the wellbore 12 outside the pump 200 in the vicinity of the reservoir fluid inlet 54. When the pressure of the reservoir fluid 32 in the wellbore 12 in the vicinity of the reservoir fluid inlet 54 exceeds the pressure of the reservoir fluid 32 contained within the lower portion of the production chamber 60 by a threshold magnitude, the standing valve 58 (if present) will open, and continued upward movement of the production piston 70 may draw reservoir fluid 32 into the production chamber 60 through the reservoir fluid inlet 54.

The movement of reservoir fluid 32 into the pump 200 through the reservoir fluid inlet 54 results in a localized reduction of pressure of the fluid in the wellbore 12 proximate to the zone of fluid influx 18 (FIG. 1). In some embodiments, the pressure in the wellbore 12 proximate to the zone of fluid influx 18 may be reduced to a magnitude less than the in situ pressure of the surrounding geological formation 16. Thus, there is a drawdown pressure created that provides a driving force to draw fluid contained within the surrounding geological formation 16 to flow toward, and into, the wellbore 12 at the zone of fluid influx 18. In some embodiments, the pressure in the wellbore 12 proximate to the zone of fluid influx 18 may be reduced to a magnitude that is, at least temporarily, significantly less than the in situ pressure of the surrounding geological formation 16. In some embodiments, the pressure in the wellbore 12 proximate to the zone of fluid influx 18 may be reduced to a magnitude that is, at least temporarily, substantially equal to atmospheric pressure. In some embodiments, the pressure in the wellbore 12 proximate to the zone of fluid influx 18 may be reduced to a magnitude that is, at least temporarily, less than atmospheric pressure.

Still referring to the upward movement of the production piston 70, the reduced pressure of the reservoir fluid 32 within the lower portion of the production chamber 60 and the forcing of reservoir fluid 32 out of the upper portion of the production chamber 60 into the transfer tube 80 results in the pressure of the reservoir fluid 32 in the transfer tube 80 at the first traveling valve 78 exceeding the pressure of the reservoir fluid 32 within the lower portion of the production chamber 60. Therefore, the first traveling valve 78 will be held in a closed position, and will prevent fluid transfer between the transfer tube 80 and the lower portion of the production chamber 60. Thus, the reservoir fluid 32 that enters the transfer tube 80 through the through the port 84 travels upward through the transfer tube 80.

In the transfer tube 80, the second traveling valve 100 experiences a pressure from above derived at least in part from the pressure of the reservoir fluid 32 being moved out of the upper portion of the reset chamber 62. This fluid travels relatively unhindered upward through the transfer tube 80, and becomes commingled with the reservoir fluid 32 within and moving out of the upper portion of the drive chamber 66 and into the produced fluid conduit 30. The second traveling valve 100 experiences a pressure from below derived at least in part from the pressure of the reservoir fluid 32 being moved out of the upper portion of the production chamber 60 and into the transfer tube 80. Because the first traveling valve 78 is closed, the only available flow path for this fluid is upward through the transfer tube 80. Continued upward movement of the production piston 70 forces more reservoir fluid 32 out of the upper portion of the production chamber 60 and into the transfer tube 80 toward the second traveling valve 100. Thus the pressure exerted by the reservoir fluid 32 in the transfer tube 80 below the second traveling valve 100 will increase until the pressure exerted by the reservoir fluid 32 in the transfer tube 80 below the second traveling valve 100 exceeds the pressure exerted by the reservoir fluid 32 in the transfer tube 80 above the second traveling valve 100 by a threshold value. At this point the second traveling valve 100 will open to allow the reservoir fluid 32 in the transfer tube 80 below the second traveling valve 100 to move through the second traveling valve 100 and commingle with the reservoir fluid 32 in the transfer tube 80 that is exiting the upper portion of the reset chamber 62.

Therefore, in summary, during a production stroke of the pistons 70, 88, and 106 in the pump 200, the standing valve 58 (if present) opens to allow reservoir fluid 32 into the lower portion of the production chamber 60, the first traveling valve 78 closes, the second traveling valve 100 opens, and reservoir fluid 32 in the upper portion of the production chamber 60 and in the upper portion of the reset chamber 62 enters the transfer tube 80. Reservoir fluid 32 in the transfer tube 80 flows out of the upper end of the transfer tube 80 and commingles with reservoir fluid 32 in the upper portion of the drive chamber 66. Reservoir fluid 32 in the upper portion of the drive chamber 66 flows out of the pump 200 and into the produced fluid conduit 30. Additionally, reservoir fluid 32 moves upward through the produced fluid conduit 30, and reservoir fluid 32 flows out of the produced fluid conduit 30 at the surface 34 and through the outlet 38 of the wellhead 36.

With the pump 10 as illustrated in FIG. 3, the transfer tube 80 is placed in axial tension during a production stroke by the action of the drive piston 106 and/or the reset piston 88 pulling the production piston 70. By being in axial tension rather than axial compression, the transfer tube 80 is less susceptible to buckling. Hence, such a risk of buckling does not inhibit the effective configuration of the operating conditions for the production stroke. Thus, for example, a rate of travel of the pistons 70, 88, and 106 during the production stroke may be regulated as required to suit the desired operational circumstances for each wellbore 12. The enabling of such regulation facilitates effective control of the rate at which fluids from the geological formation 16 move into the wellbore 12 and become drawn into the pump 200.

FIG. 4 illustrates operation of the pump 200 during a second phase. The second phase may be referred to as a reset stroke. For the pump 200 of FIG. 2, the reset stroke is a down stroke of the pistons 70, 88, and 106. A reset stroke is initiated at the surface 34 by a release of pressure that had been applied to the power fluid 28 in the power fluid conduit 26 during the production stroke. The release of pressure is performed by the pulsar unit 42, such as by reversing a movement of piston 44 in cylinder 46 (FIG. 1). In some embodiments, the release of pressure brings the magnitude of the pressure applied at surface 34 down to substantially equal atmospheric pressure. In some embodiments, the release of pressure brings the magnitude of the pressure applied at surface 34 down to a value that is above atmospheric pressure. In some embodiments, the release of pressure brings the magnitude of the pressure applied at surface 34 down to a value that is less than atmospheric pressure, in other words at least a partial vacuum.

The reduction of the pressure applied at surface 34 to the column of power fluid 28 in the power fluid conduit 26 results in a reduction of the pressure experienced by the power fluid 28 within the lower portion of the drive chamber 66 and the lower portion of the reset chamber 62. By appropriate selection of the power fluid 28, and particularly the density of the power fluid 28, the pressure of the power fluid 28 in the lower portion of the drive chamber 66 and in the lower portion of the reset chamber 62 will be less than the pressure of the reservoir fluid 32 within the upper portion of the drive chamber 66 and in the upper portion of the reset chamber 62, respectively. Additionally, or alternatively, a pressure may be applied at surface 34 to the reservoir fluid 32 in the production conduit. Hence, the drive piston 106 and the reset piston 88 experience pressure imbalances that cause the drive piston 106 and the reset piston 88 to move downward.

Downward movement of the reset piston 88 results in reservoir fluid 32 within the upper portion of the drive chamber 66 being drawn into the upper portion of the reset chamber 62 through the transfer tube 80 and port 102. Downward movement of the drive piston 106 results in reservoir fluid 32 within the produced fluid conduit 30 being drawn into the upper portion of the drive chamber 66. Downward movement of the drive piston 106 and the reset piston 88 also results in power fluid 28 being forced out of the lower portion of the drive chamber 66 and the lower portion of the reset chamber 62, respectively, and into the power fluid passage 92. Power fluid 28 in the power fluid passage 92 may be forced into the power fluid conduit 26.

Downward movement of the drive piston 106 and the reset piston 88 also causes downward movement of the production piston 70 because of the coupling between the pistons provided by the transfer tube 80. Downward movement of the production piston 70 results in enlargement of the upper portion of the production chamber 60, which causes a localized reduction in pressure.

Because of the port 84, this reduction in pressure is also experienced by the reservoir fluid 32 in the portion of the transfer tube 80 between the first traveling valve 78 and the second traveling valve 100. The pressure the reservoir fluid 32 will be substantially equal to the full hydrostatic head of the column of the reservoir fluid 32 in the produced fluid conduit 30, and hence the pressure of the reservoir fluid 32 below the second traveling valve 100 will become less than the pressure of the reservoir fluid 32 above the second traveling valve 100. Thus, the second traveling valve 100 will close, thereby preventing passage of fluid therethrough.

Downward movement of the production piston 70 also reduces the size of the lower portion of the production chamber 60, which causes therein a localized increase in pressure. When the pressure of the reservoir fluid 32 in the lower portion of the production chamber 60 exceeds the pressure of the reservoir fluid 32 above the first traveling valve 78 by a threshold magnitude, the first traveling valve 78 will open, thereby allowing reservoir fluid 32 to flow from the lower portion of the production chamber 60 into the transfer tube 80 and through the port 84 into the upper portion of the production chamber 60. Additionally, the increased pressure in the lower portion of the production chamber 60 will cause the standing valve 58 (if present) to close, thereby preventing reservoir fluid 32 from transferring between the lower portion of the production chamber 60 and the exterior of the pump 200.

Therefore, in summary, during a reset stroke of the pistons 70, 88, and 106 in the pump 200, the standing valve 58 (if present) closes to prevent reservoir fluid 32 in the lower portion of the production chamber 60 from exiting the pump 200 through the reservoir fluid inlet 54. Additionally, the first traveling valve 78 opens, the second traveling valve 100 closes, and reservoir fluid 32 in the lower portion of the production chamber 60 flows into the upper portion of the production chamber 60. Some reservoir fluid 32 in the transfer tube 80 below the second traveling valve 100 may also flow into the upper portion of the production chamber 60. Some reservoir fluid 32 in the produced fluid conduit 30 may flow back into the upper portion of the drive chamber 66, and may flow through the portion of the transfer tube 80 above the second traveling valve 100 into the upper portion of the reset chamber 62. Furthermore, some power fluid 28 in the lower portion of the drive chamber 66 and the lower portion of the reset chamber 62 may flow into the power fluid passage 92, and may flow into the power fluid conduit 26.

Pump 200 operation continues as described above with a repeated sequence of a production stroke followed by a reset stroke. Thus, reciprocal action of the pistons of the pump 200 results in the production of reservoir fluid 32 to the surface 34. Because pump 200 operates by the sequential drawing and expelling of reservoir fluid 32 into and out of the production chamber 60 by production piston 70, pump 200 may be considered as a positive displacement pump.

Additional Pump Embodiments

Figure 5:
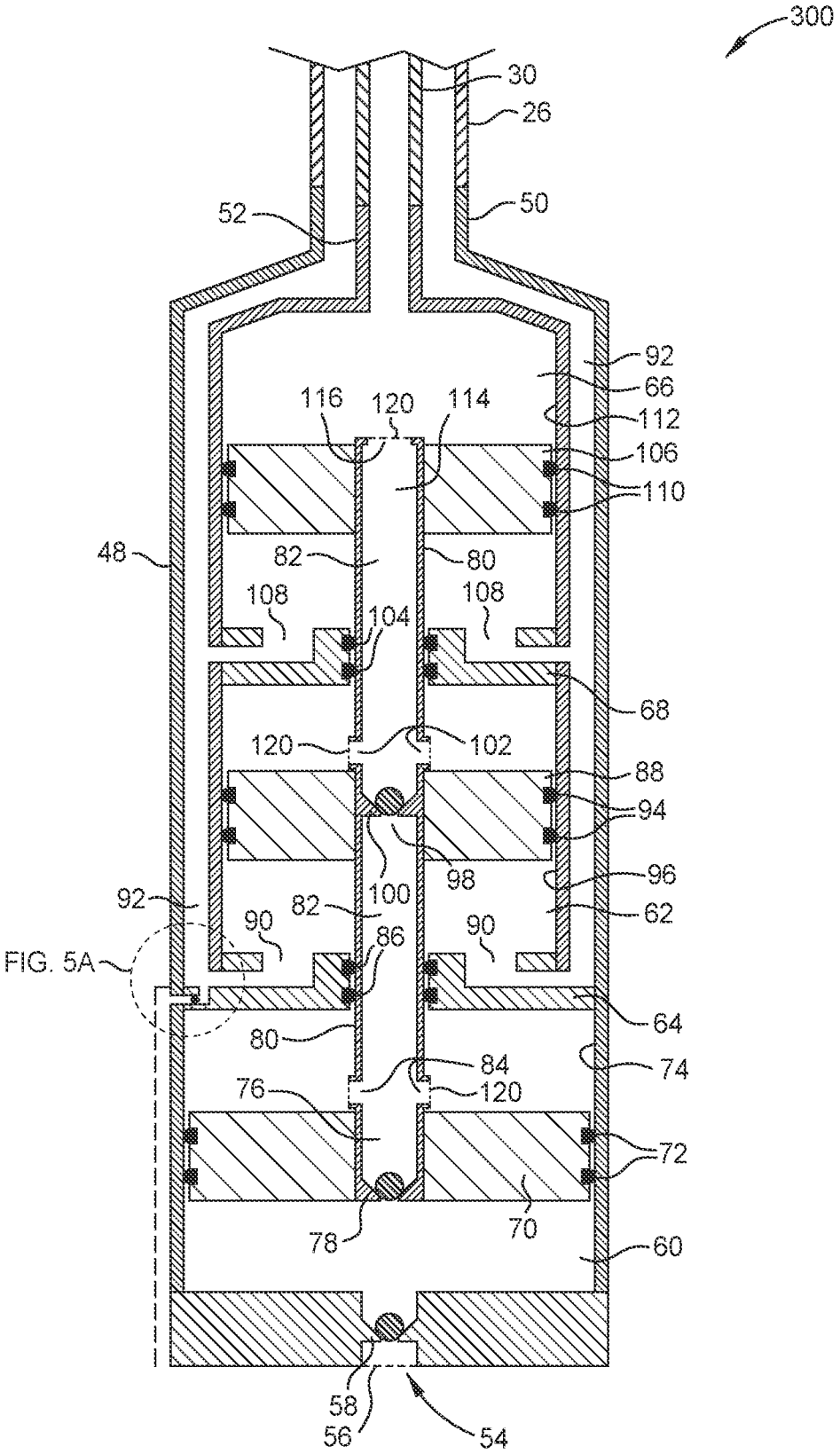
FIG. 5 is a schematic illustration of an embodiment of a pump.

FIG. 5 is a schematic longitudinal cross-sectional view of a pump 300 that is suitable for installation and operation in a wellbore, such as wellbore 12. Pump 300 is an example of pump 10 from FIG. 1. Pump 300 is a variant of pump 200, and includes the features of pump 200; common components are denoted by the same reference numerals used in the description of pump 200, above. Pump 300 is configured to enable treatment of fluids external to the pump 300 with one or more chemicals carried by the power fluid 28. Example treatment chemicals may include any one or more of a corrosion inhibitor, a scale inhibitor, a wax deposition inhibitor, a demulsifier, a pH modifier, a hydrogen sulfide scavenger, or any other chemical used to treat fluids in a downhole environment.

Figure 5A:
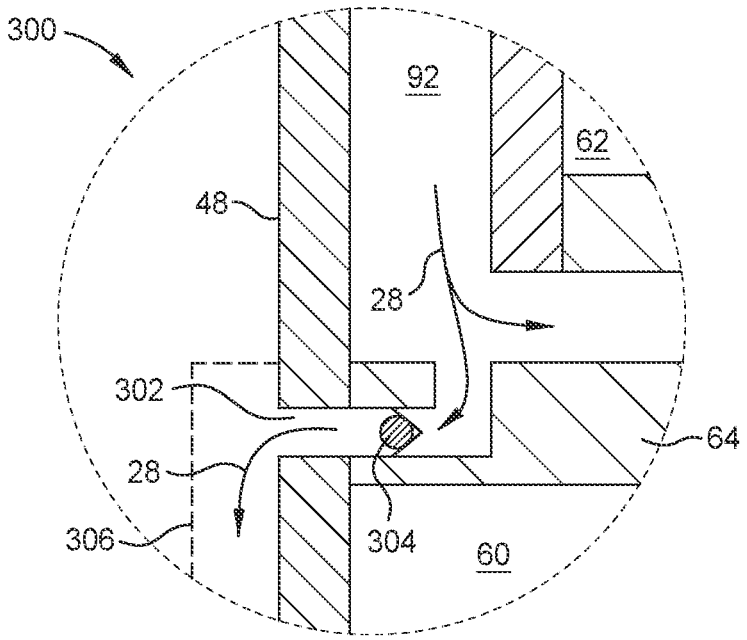
FIG. 5A is an enlargement of a portion of FIG. 5.

Pump 300 includes a facility to inject power fluid 28 from the power fluid passage 92 into a region external to the pump 300. FIG. 5A is an enlargement of a portion of FIG. 5. A port 302 provides a conduit for power fluid 28 to exit the power fluid passage 92. As illustrated, the port 302 is routed through the first bulkhead 64 and through a wall of the housing 48. In some embodiments, it is contemplated that the port 302 may be routed through the wall of the housing 48 without being routed through the first bulkhead 64.

An injection valve 304 is disposed within the port 302. In some embodiments, the injection valve 304 is configured to facilitate a continual seepage or drip feed of small volumes, such as up to 1 fluid ounce (30 ml), up to 2 fluid ounces (59 ml), up to 5 fluid ounces (148 ml), or up to 10 fluid ounces (296 ml), of power fluid 28 per day. For example, the injection valve 304 may include an orifice, such as a nozzle.

In some embodiments, the injection valve 304 is configured to inhibit the passage of power fluid 28 therethrough until subjected to a differential pressure that opens the injection valve 304. For example, the injection valve 304 may be a check valve configured to allow passage of fluid out of the pump through the port 302, and inhibit the passage of fluid into the pump through the port 302. The injection valve 304 may be configured to open upon a differential pressure between the power fluid passage 92 and an exterior of the pump 300 reaching a threshold magnitude. The threshold magnitude of differential pressure may be preselected. In some embodiments, the injection valve 304 may be configured to open upon the differential pressure between the power fluid passage 92 and the exterior of the pump 300 reaching a first threshold magnitude, and remain open until the differential pressure between the power fluid passage 92 and the exterior of the pump 300 reduces to a second, lower, threshold magnitude.

In some embodiments, operation of the injection valve 304 is controlled to occur after a selected number of successive production strokes of the pump 300. For example, one, two, three, four, five, or more production strokes (and corresponding reset strokes) of the pump 300 may be completed in succession before the injection valve 304 is actuated as described above during, or upon completion of, the subsequent production stroke.

In some embodiments, operation of the injection valve 304 is controlled to occur after a selected time delay since a previous operation of the injection valve 304. In some embodiments, operation of the injection valve 304 is controlled to occur after a selected volume of fluid has been produced from the wellbore 12 since a previous operation of the injection valve 304.

In some embodiments, as shown in FIGS. 5 and 5A, the port 302 is in fluid communication with an external fluid conduit, such as capillary line 306. The capillary line 306 provides a conduit for power fluid 28 exiting through the port 302 to flow towards the reservoir fluid inlet 54. It is contemplated that at least a portion of the so-conveyed power fluid 28 becomes commingled with reservoir fluid entering the pump 300 through the reservoir fluid inlet 54. It is further contemplated that the portions of the pump 300 that are exposed to reservoir fluid become treated by the chemical(s) carried by the power fluid 28 entering the pump 300 through the reservoir fluid inlet 54.

In other embodiments, the capillary line 306 is omitted. Nevertheless, it is contemplated that the power fluid 28 exiting through the port commingles with reservoir fluid surrounding the pump 300. It is further contemplated that at least a portion of the commingled power fluid 28 and reservoir fluid enters the pump 300 through the reservoir fluid inlet 54, thereby facilitating the chemical treatment of the pump.

Whether or not capillary line 306 is present, it is contemplated that wellbore equipment downstream of the connection 52 to the produced fluid conduit 30, such as produced fluid conduit 30 itself, becomes treated by the chemical(s) carried by the power fluid 28 commingled with the reservoir fluid that is conveyed by the pump 300.

Figure 6A:
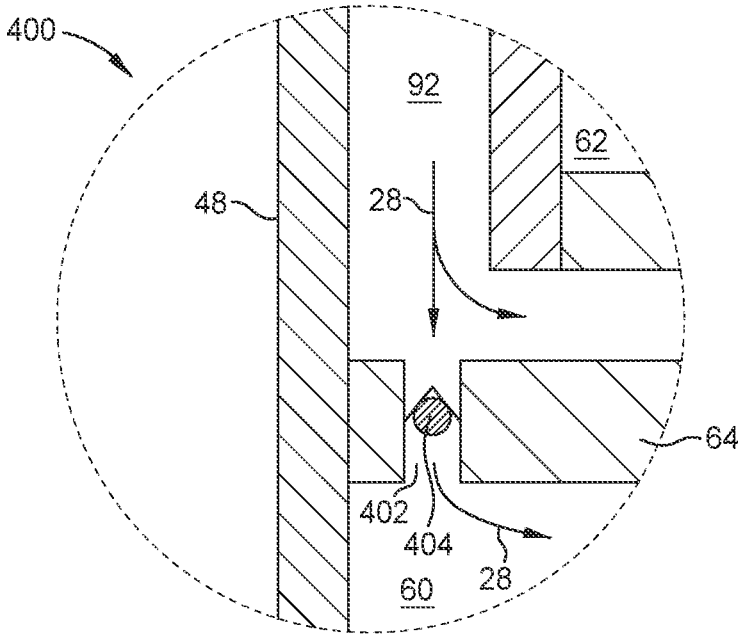
FIG. 6A is an enlargement of a portion of FIG. 6.
Figure 6:
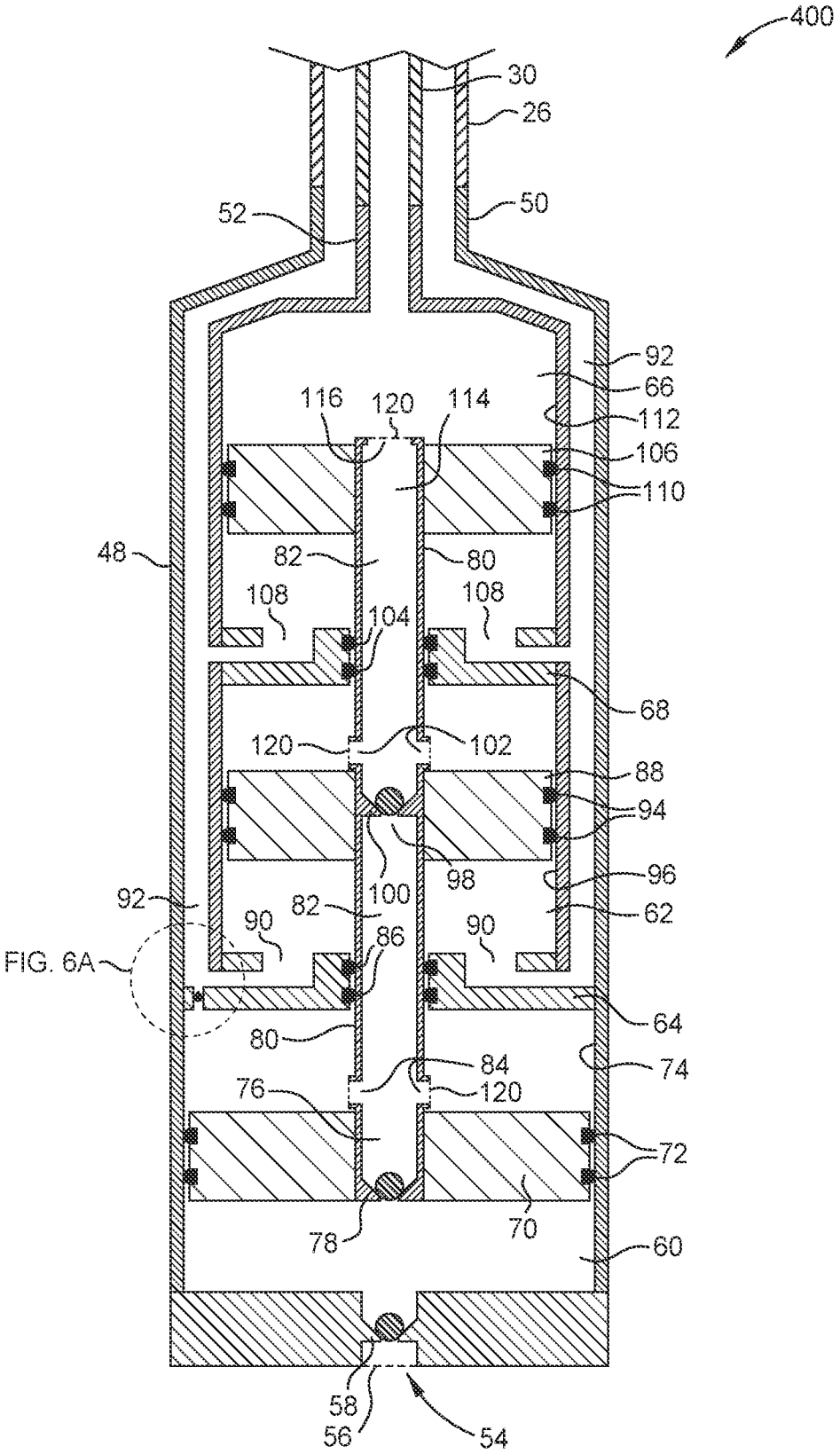
FIG. 6 is a schematic illustration of an embodiment of a pump.

FIG. 6 is a schematic longitudinal cross-sectional view of a pump 400 that is suitable for installation and operation in a wellbore, such as wellbore 12. Pump 400 is an example of pump 10 from FIG. 1. Pump 400 is a variant of pump 200, and includes the features of pump 200; common components are denoted by the same reference numerals used in the description of pump 200, above. Pump 400 is configured to enable direct treatment of fluids internal to the pump 400 with one or more chemicals carried by the power fluid 28. Example treatment chemicals may include any one or more of a corrosion inhibitor, a scale inhibitor, a wax deposition inhibitor, a demulsifier, a pH modifier, a hydrogen sulfide scavenger, or any other chemical used to treat fluids in a downhole environment.

Pump 400 includes a facility to inject power fluid 28 from the power fluid passage 92 into the production chamber 60 above the production piston 70. FIG. 6A is an enlargement of a portion of FIG. 6. A port 402 provides a conduit through the first bulkhead 64 for power fluid 28 to enter the production chamber 60.

An injection valve 404 is disposed within the port 402. In some embodiments, the injection valve 404 is configured to facilitate a continual seepage or drip feed of small volumes, such as up to 1 fluid ounce (30 ml), up to 2 fluid ounces (59 ml), up to 5 fluid ounces (148 ml), or up to 10 fluid ounces (296 ml), of power fluid 28 per day. For example, the injection 404 valve may include an orifice, such as a nozzle.

In some embodiments, the injection valve 404 is configured to inhibit the passage of power fluid 28 therethrough until subjected to a differential pressure that opens the injection valve 404. For example, the injection valve 304 may be a check valve configured to allow passage of fluid from the power fluid passage 92 into the production chamber 60, and inhibit the passage of fluid from the production chamber 60 into the power fluid passage 92. The injection valve 404 may be configured to open upon a differential pressure between the power fluid passage 92 and the portion of the production chamber 60 above the production piston 70 reaching a threshold magnitude. The threshold magnitude of differential pressure may be preselected. In some embodiments, the injection valve 404 may be configured to open upon the differential pressure between the power fluid passage 92 and the portion of the production chamber 60 above the production piston 70 reaching a first threshold magnitude, and remain open until the differential pressure between the power fluid passage 92 and the portion of the production chamber 60 above the production piston 70 reduces to a second, lower, threshold magnitude.

In some embodiments, operation of the injection valve 404 is controlled to occur after a selected number of successive production strokes of the pump 400. For example, one, two, three, four, five, or more production strokes (and corresponding reset strokes) of the pump 400 may be completed in succession before the injection valve 404 is actuated as described above during, or upon completion of, the subsequent production stroke.

In some embodiments, operation of the injection valve 404 is controlled to occur after a selected time delay since a previous operation of the injection valve 404. In some embodiments, operation of the injection valve 404 is controlled to occur after a selected volume of fluid has been produced from the wellbore 12 since a previous operation of the injection valve 404.

It is contemplated that portions of the pump 400 that are exposed to reservoir fluid commingled with power fluid 28 that enters the production chamber 60 through port 402 become treated by the chemical(s) carried by the power fluid 28. Additionally, it is contemplated that wellbore equipment downstream of the connection 52 to the produced fluid conduit 30, such as produced fluid conduit 30 itself, becomes treated by the chemical(s) carried by the power fluid 28 commingled with the reservoir fluid that is conveyed by the pump 400.

Figure 7:
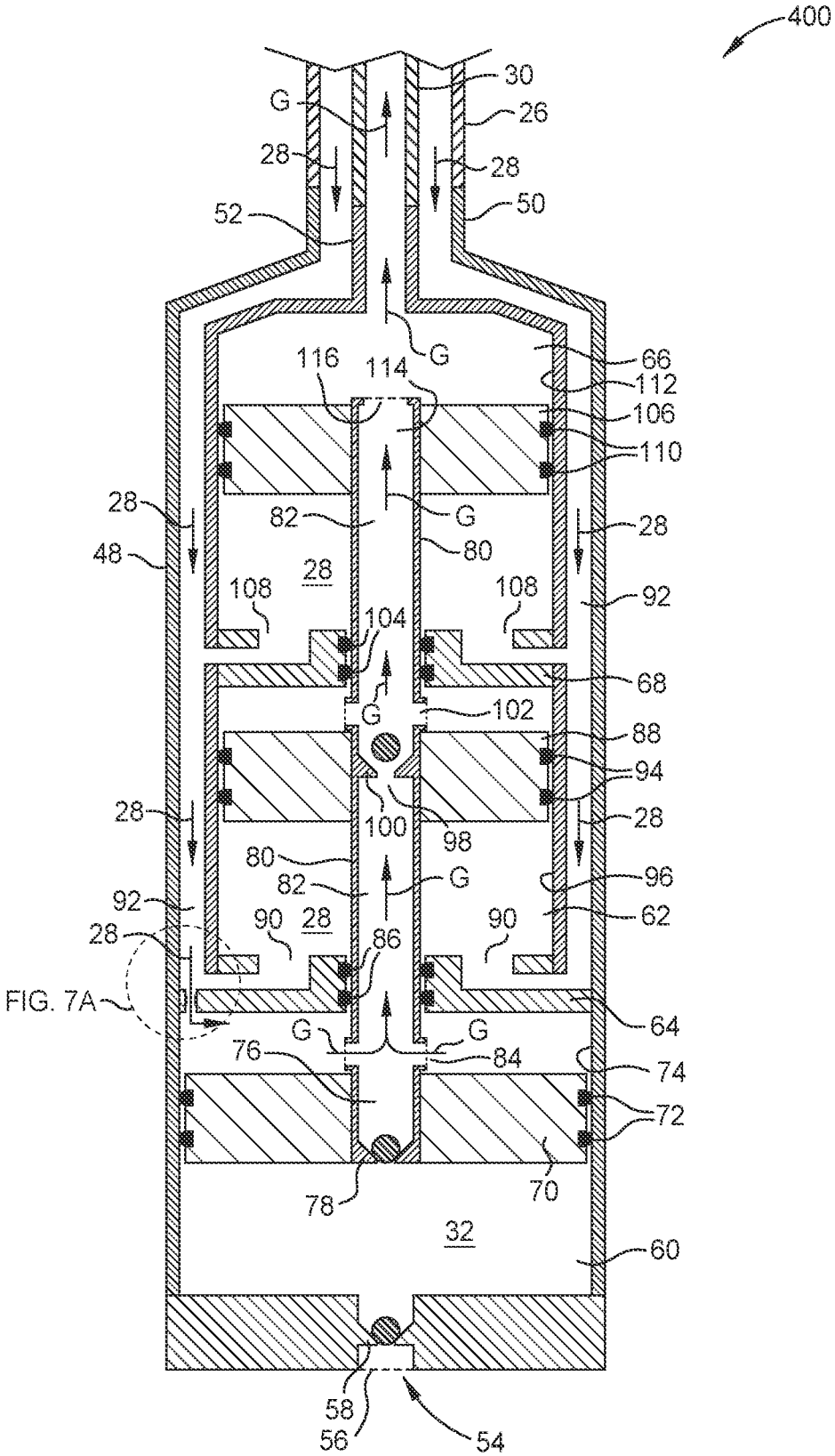
FIG. 7 is a schematic illustration of the embodiment of the pump of FIG. 6 during an operation.

In a further embodiment, the pump 400 may be operated to relieve gas-locking. FIG. 7 is a schematic longitudinal cross-sectional view of pump 400 during an operation to relieve gas-locking. Gas-locking may occur if gas entrained with reservoir fluid accumulates in the pump 400. For example, gas may become trapped in the transfer tube 80 between the first traveling valve 78 and the second traveling valve 100. Additionally, gas may become trapped in the portion of the production chamber 60 above the production piston 70. Without being bound by theory, an exemplary mechanism of gas-locking occurs when sufficient gas is trapped such that an upstroke of the production piston 70 merely compresses the gas without causing the second traveling valve 100 to open. In such an example, the pressure of the trapped gas below the second traveling valve may be insufficient to overcome the in situ pressure of the fluid above the second traveling valve 100.

An operator can diagnose gas-locking, such as via examining patterns over time of the outlet pressure of the pulsar unit (42, FIG. 1) to establish that the reset 88 and drive 106 pistons are operating, and/or verifying the pump 400 is located below the fluid level in the wellbore (10, FIG. 1) external to the tubing string (20, FIG. 1), and/or observing that very little or no fluid is being produced at the wellhead outlet (38, FIG. 1). If the operator diagnoses, or suspects that, gas-locking is occurring, the operator can initiate a remedial operation. In some embodiments, the diagnosis may be performed by a computer. In such embodiments, the computer may provide an alert to the operator. Additionally, or alternatively, the computer may initiate the remedial operation. In some embodiments, the remedial operation may be initiated according to a pre-programmed schedule.

Figure 7A:
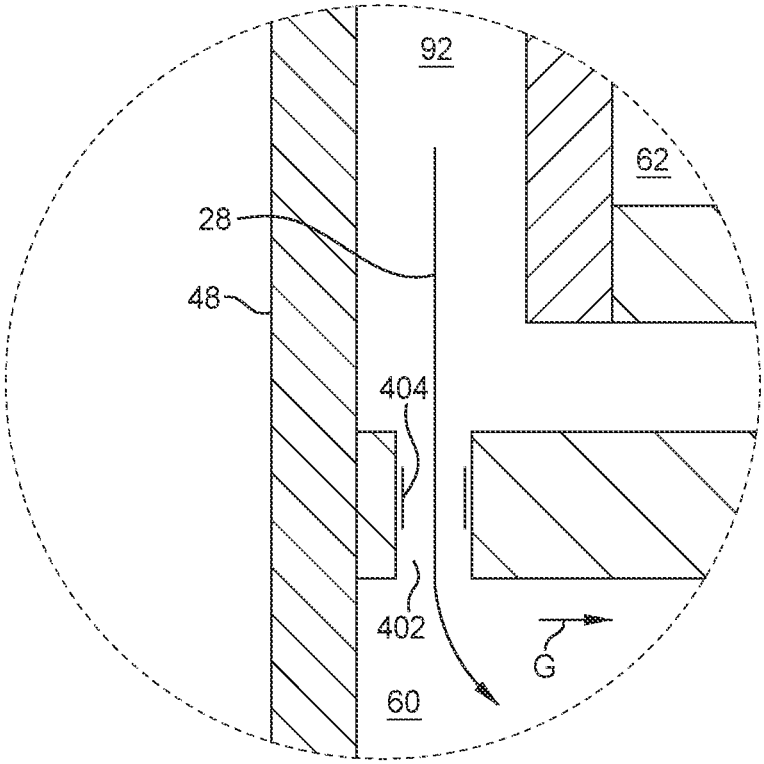
FIG. 7A is an enlargement of a portion of FIG. 7.

FIGS. 7 and 7A illustrate the remedial operation to relieve gas-locking. When the reset 88 and drive 106 pistons reach the tops of their respective strokes at the end of a production cycle, the pressure applied to the power fluid 28, such as by the pulsar (42, FIG. 1), is increased beyond a threshold magnitude in order to open the injection valve 404. Power fluid 28 in the power fluid passage 92 passes through the port 402 and the injection valve 404, and enters the portion of the production chamber 60 that is above the production piston 70. Passage of power fluid 28 through port 402 compresses gas G present in the portion of the production chamber 60 that is above the production piston 70 and present in the transfer tube 80 between the first traveling valve 78 and the second traveling valve 100.

Downward movement of the production piston 70 is limited by closure of the standing valve 58 and by the first traveling valve 78 remaining closed, thereby creating a sealed compartment of reservoir fluid 32 below the first traveling valve 78. Hence, continued pumping of power fluid 28 through port 402 further compresses gas G present in the portion of the production chamber 60 that is above the production piston 70 and present in the transfer tube 80 between the first traveling valve 78 and the second traveling valve 100.

The pressure of the gas G in the transfer tube below the second traveling valve 100 increases with continued passing of power fluid 28 through port 402. When the pressure of the gas G in the transfer tube 80 below the second traveling valve 100 exceeds the in situ pressure of the fluid above the second traveling valve 100, the second traveling valve 100 opens. The gas G in the transfer tube 80 passes through the second traveling valve 100, up through the port 116, into the drive chamber 66, and out of the pump 400 through the connection 52 to the produced fluid conduit 30. Power fluid 28 entering the production chamber 60 flushes gas G through the port 84 into the transfer tube 80, and through the second traveling valve 100.

Pumping of power fluid 28 is ceased after a selected duration and/or after determining (such as via analyzing patterns of pumping pressure) that the relieving of gas-locking has occurred. Upon the cessation of pumping power fluid 28, the pressure of the power fluid 28 is reduced. In embodiments in which the injection valve 404 is a check valve, or is another type of valve that is configured to open and close at one or more selected pressure differentials, the injection valve 404 closes, and power fluid 28 no longer passes into the production chamber 60 through port 402. Operation of the pump 400 continues with a reset stroke, as described above.

Surface Package

Figure 8:
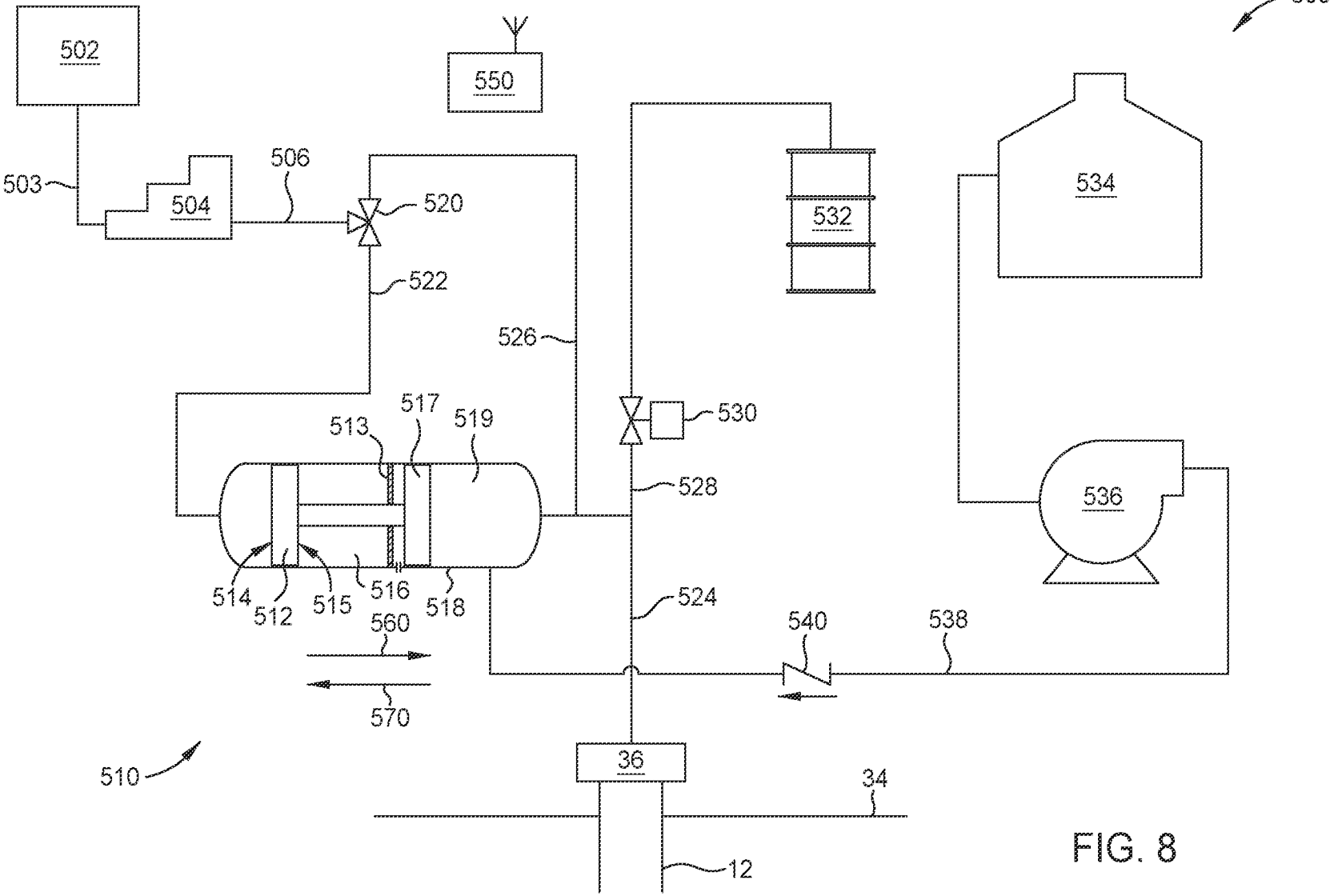
FIGS. 8 and 9 are schematic illustrations of equipment at a well site during selected operations of a pump.
Figure 9:
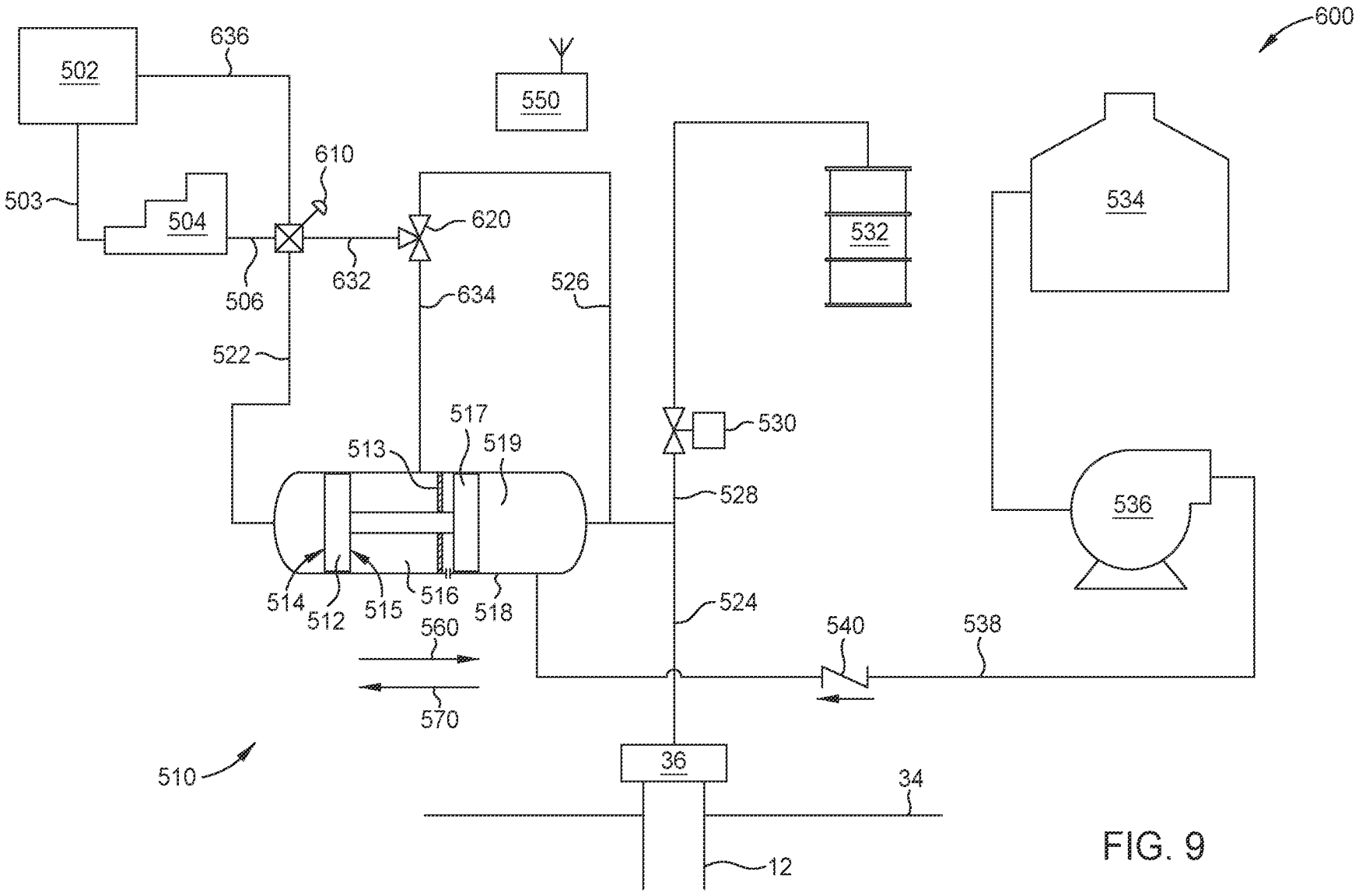

FIGS. 8 and 9 are schematic illustrations of well site equipment for the operation of a downhole pump, such as pump 10, pump 200, pump 300, or pump 400. FIGS. 8 and 9 present simplified flow diagrams for different modes of operation. In FIG. 8, the depicted collection of well site equipment is referred to as a surface equipment package 500 that is coupled to wellhead 36, from which wellbore 12 extends below surface 34, such as shown in FIG. 1. A master pump 504 receives a feed of fluid from a main reservoir 502 via line 503. In some embodiments, the main reservoir 502 may be a tank. The output of fluid from the master pump 504 in line 506 is routed by valve 520 through line 522 to a pulsar 510. In some embodiments, valve 520 is a three-way valve, as illustrated in FIG. 8. In some embodiments, valve 520 includes a plurality of valves that collectively functions as a three-way valve. Pulsar 510 is similar, or equivalent, to pulsar unit 42 of FIG. 1. In some embodiments, it is contemplated that the fluid sourced from the main reservoir 502 is the same as, or similar to, the power fluid 28 that drives the pump in the wellbore 12.

The pulsar 510 includes a cylinder 518 that is divided by a bulkhead 513 into a drive chamber 516 and a power fluid chamber 519. A master piston 512 reciprocates within the drive chamber 516, and separates the drive chamber into a power side 514 and an opposite reset side 515. The master piston 512 is coupled through the bulkhead 513 to a power fluid piston 517 that reciprocates within the power fluid chamber 519. When a fluid pressure applied to the master piston 512 causes the master piston 512 to move, the power fluid piston 517 also moves accordingly. When a fluid pressure applied to the power fluid piston 517 causes the power fluid piston 517 to move, the master piston 512 also moves accordingly.

The master piston 512 and power fluid piston 517 move in the direction of arrow 560 during a production stroke of the downhole pump. The master piston 512 and power fluid piston 517 move in the direction of arrow 570 during a reset stroke of the downhole pump. The direction of arrow 570 is opposite to the direction of arrow 560.

When performing a production stroke of a downhole pump a downhole pump in wellbore 12, the fluid in line 522 is routed to the power side 514 of the master piston 512 of the pulsar 510. The pressure of the fluid acting on the power side 514 of the master piston 512 causes movement of the master piston 512 in the direction of arrow 560. Movement of the master piston 512 causes movement of the power fluid piston 517 in the direction of arrow 560. Movement of the power fluid piston 517 forces power fluid 28 out of the power fluid chamber 519, feeding the power fluid 28 from the pulsar 510 to the wellhead 36 through line 524. The power fluid 28 is thus used to operate the downhole pump.

In some embodiments, when performing a reset stroke of the downhole pump, pressure at the power side 514 of the master piston 512 is bled off. The pressure of power fluid 28 in the wellbore 12 acts through line 524 on the power fluid piston 517 in the power fluid chamber 519. The pressure of power fluid 28 acting on the power fluid piston 517 causes movement of the power fluid piston 517 in the direction of arrow 570. Movement of the power fluid piston 517 causes movement of the master piston 512 in the direction of arrow 570. Fluid in the drive chamber 516 at the power side 514 of the master piston 512 is routed back to the main reservoir 502, such as through line 522 or through another conduit (not shown). In some embodiments, when performing a reset stroke of the downhole pump, the output of fluid from the master pump 504 in line 506 is routed to the reset side 515 of the master piston 512 of the pulsar 510, such as through a branch off of line 522 or through another conduit (not shown).

In some embodiments, the surface equipment package 500 includes a facility for the output from the master pump 504 in line 506 to bypass the master piston 512 of the pulsar 510. The output from the master pump 504 is routed by valve 520 through bypass line 526 into line 524 and on to the wellhead 36. Bypass line 526 is coupled directly or indirectly to line 524, and permits the output of the master pump 504 to be routed to the wellhead 36, bypassing the master piston 512 of the pulsar 510. In some embodiments, the bypass line 526 is not directly coupled to the pulsar 510, hence operation of the bypass facility permits the output of the master pump 504 to be routed to the wellhead 36, bypassing the pulsar 510.

In some embodiments, the output from the master pump 504 is routed through the bypass line 526 when it is desired to use the power fluid 28 to perform an auxiliary operation following completion of a production stroke of the downhole pump. In one example, the auxiliary operation includes injecting a treatment chemical carried by the power fluid 28 into a region outside the downhole pump, such as the operation described above with respect to FIGS. 5 and 5A. In another example, the auxiliary operation includes injecting a treatment chemical carried by the power fluid 28 into the production chamber 60 of the downhole pump, such as the operation described above with respect to FIGS. 6 and 6A. In another example, the auxiliary operation includes injecting power fluid 28 into the production chamber 60 of the downhole pump in order to combat gas-locking of the downhole pump, such as the operation described above with respect to FIGS. 7 and 7A.

In some embodiments, the bypass facility described above may be omitted. In an example, bypass line 526 is omitted. In another example, bypass line 526 is omitted, and valve 520 is omitted. In a further example, bypass line 526 is omitted, and valve 520 is not configured as a three-way valve. In such an example, valve 520 may be configured to regulate fluid flow between line 506 and line 522.

In some embodiments, the surface equipment package 500 includes a pressure relief facility for the power fluid 28. A relief line 528 routes power fluid from line 524 into an overflow tank 532. Flow through relief line 528 is regulated by a relief valve 530. In some embodiments, the relief valve 530 is normally closed. In some embodiments, the relief valve 530 is configured to open to allow flow through relief line 528 when the pressure of power fluid 28 within line 524 reaches a threshold magnitude. In some embodiments, the relief valve 530 is opened automatically in response to a command from a control system, such as controller 550. In some embodiments, the relief valve 530 is opened manually. The overflow tank 532 is depicted as a distinct vessel, however, in some embodiments, the overflow tank 532 and the main reservoir 502 may be one and the same vessel and/or may be different compartments of a vessel. In some embodiments, the pressure relief facility described above may be omitted.

In some embodiments, the surface equipment package 500 includes a fluid replenishment facility for the power fluid 28. A transfer pump 536 provides power fluid 28 from a replenishment reservoir 534 through transfer line 538 to the pulsar 510. Additionally, or alternatively, the transfer line 538 may be connected directly to the line 524 feeding power fluid 28 to the wellhead 36. Additionally, or alternatively, the transfer line 538 may be connected directly to the wellhead 36. In some embodiments, a check valve 540 is included in the transfer line 538 in order to hinder back flow of power fluid 28 to the transfer pump 536.

The replenishment reservoir 534 is depicted as a distinct vessel, however, in some embodiments, the replenishment reservoir 534 and the main reservoir 502 may be one and the same vessel and/or may be different compartments of a vessel. Additionally, or alternatively, in some embodiments, the replenishment reservoir 534 and the overflow tank 532 may be one and the same vessel and/or may be different compartments of a vessel.

In some embodiments, the fluid replenishment facility is operated to perform an auxiliary operation following completion of a production stroke of the downhole pump. In one example, the auxiliary operation includes injecting a treatment chemical carried by the power fluid 28 into a region outside the downhole pump, such as the operation described above with respect to FIGS. 5 and 5A. In another example, the auxiliary operation includes injecting a treatment chemical carried by the power fluid 28 into the production chamber 60 of the downhole pump, such as the operation described above with respect to FIGS. 6 and 6A. In another example, the auxiliary operation includes injecting power fluid 28 into the production chamber 60 of the downhole pump in order to combat gas-locking of the downhole pump, such as the operation described above with respect to FIGS. 7 and 7A.

In some embodiments, the fluid replenishment facility provides for a topping up of power fluid 28 to compensate for losses of power fluid 28. For example, power fluid 28 may be lost due to leaks within the surface equipment package 500, and/or leaks at the wellhead 36, and/or leaks within the wellbore 12, and/or losses within the pump 10/200/300/400 (such as through leaks or any operation described above). In some embodiments, the reset stroke of the downhole pump is facilitated at least in part by pumping fluid from the replenishment reservoir 534 through transfer line 538 to the power fluid chamber 519 of the pulsar 510. The fluid from the replenishment reservoir 534 commingles with power fluid 28 in the power fluid chamber 519, and the pressure of the commingled fluid acts on the power fluid piston 517 to cause the power fluid piston to move in the direction of arrow 570.

In some embodiments, the fluid replenishment facility provides power fluid 28 that is dosed with a treatment chemical, such as described above. In some embodiments, the fluid replenishment facility described above may be omitted.

In FIG. 9, the depicted collection of well site equipment is referred to as a surface equipment package 600 that is coupled to wellhead 36, from which wellbore 12 extends below surface 34, such as shown in FIG. 1. Items common to surface equipment package 600 and surface equipment package 500 are labeled with common reference numbers. The description with respect to surface equipment package 500 applies also to surface equipment package 600, except for certain differences that are explained below.

In surface equipment package 600, line 506 conveys the output of fluid from the master pump 504 to a valve 610. In some embodiments, valve 610 is a four-way valve, as illustrated in FIG. 9. In some embodiments, valve 610 includes a plurality of valves that collectively functions as a four-way valve. Line 636 couples the valve 610 to the main reservoir 502. Line 522 couples the valve 610 to the pulsar 510 at the power side 514 of the master piston 512. Line 632 couples the valve 610 to valve 620. In some embodiments, valve 620 is a three-way valve, as illustrated in FIG. 9. In some embodiments, valve 620 includes a plurality of valves that collectively functions as a three-way valve. Line 634 couples the valve 620 to the pulsar 510 at the reset side 515 of the master piston 512.

As illustrated, in some embodiments, the surface equipment package 600 includes a bypass facility, such as that described above with respect to surface equipment package 500. As illustrated, the bypass is facilitated by valve 620 coupled to bypass line 526. Fluid from the main reservoir 502 is pumped by master pump 504 through line 506 to valve 610. Valve 610 routes the fluid from line 506 through line 632 to valve 620. Valve 620 routes fluid from line 632 into bypass line 526.

Bypass line 526 is coupled directly or indirectly to line 524, and thus permits the output of the master pump 504 to be routed to the wellhead 36, bypassing the master piston 512 of the pulsar 510, as described above with respect to surface equipment package 500. In some embodiments, the bypass line 526 is not directly coupled to the pulsar 510, hence operation of the bypass facility permits the output of the master pump 504 to be routed to the wellhead 36, bypassing the pulsar 510. In some embodiments, the bypass facility described above may be omitted. In an example, bypass line 526 is omitted. In another example, bypass line 526 is omitted, and valve 620 is omitted. In a further example, bypass line 526 is omitted, and valve 620 is not configured as a three-way valve. In such an example, valve 620 may be configured to regulate fluid flow between line 632 and line 634.

As illustrated, in some embodiments, the surface equipment package 600 includes a pressure relief facility, such as that described above with respect to surface equipment package 500. In some embodiments, the pressure relief facility described above may be omitted. As illustrated, in some embodiments, the surface equipment package 600 includes a fluid replenishment facility, such as that described above with respect to surface equipment package 500. In some embodiments, the fluid replenishment facility described above may be omitted.

When executing a production stroke of a downhole pump in wellbore 12, fluid from the main reservoir 502 is pumped by the master pump 504 through line 506 to valve 610. Valve 610 routes the fluid from line 506 into line 522 and to the power side 514 of the master piston 512 of the pulsar 510. The pressure of the fluid acting on the power side 514 of the master piston 512 causes movement of the master piston 512 in the direction of arrow 560. Movement of the master piston 512 causes movement of the power fluid piston 517 in the direction of arrow 560. Movement of the power fluid piston 517 forces power fluid 28 out of the power fluid chamber 519, feeding the power fluid 28 from the pulsar 510 to the wellhead 36 through line 524. The power fluid 28 is thus used to operate the downhole pump. As the master piston 512 moves during a power stroke, fluid at the reset side 515 of the master piston 512 is conveyed through line 634 to valve 620. Valve 620 routes the fluid from line 634 to valve 610 through line 632. Valve 610 routes fluid from line 632 to the main reservoir 502 through line 636.

In some embodiments, when executing a reset stroke of the downhole pump, pressure at the power side 514 of the master piston 512 is bled off. The pressure of power fluid 28 in the wellbore 12 acts through line 524 on the power fluid piston 517 in the power fluid chamber 519. The pressure of power fluid 28 acting on the power fluid piston 517 causes movement of the power fluid piston 517 in the direction of arrow 570. Movement of the power fluid piston 517 causes movement of the master piston 512 in the direction of arrow 570. The fluid at the power side 514 of the master piston 512 is routed back to the main reservoir 502 via line 522, valve 610, and line 636.

In some embodiments, the reset stroke of the downhole pump is facilitated at least in part by pumping fluid from the main reservoir 502 to the reset side 515 of the master piston 512. The master pump 504 conveys fluid from the main reservoir 502 through line 506 to the valve 610. The valve 610 routes the fluid from line 506 to the valve 620 through line 632. The valve 620 routes the fluid from line 632 to the reset side 515 of the master piston 512 of the pulsar 510 through line 634. The pressure applied by the fluid at the reset side 515 of the master piston 512 causes the master piston 512 to move in the direction of arrow 570.

In some embodiments, the reset stroke of the downhole pump is facilitated at least in part by pumping fluid from the replenishment reservoir 534 through transfer line 538 to the power fluid chamber 519 of the pulsar 510. The fluid from the replenishment reservoir 534 commingles with power fluid 28 in the power fluid chamber 519, and the pressure of the commingled fluid acts on the power fluid piston 517 to cause the power fluid piston 517 to move in the direction of arrow 570.

In some embodiments, the reset stroke of the downhole pump is facilitated at least in part by routing at least a portion of the fluid in the power fluid chamber 519 of the pulsar 510 to the reset side 515 of the master piston 512. For example, at least a portion of the fluid in the power fluid chamber 519 can be routed through the bypass line 526 to the valve 620. The valve 620 then routes the fluid from bypass line 526 to the reset side 515 of the master piston 512 through line 634. The pressure of the fluid at the reset side 515 of the master piston 512 acts on the master piston 512 to cause the master piston 512 to move in the direction of arrow 570.

Downhole Pump Operation Control

In some embodiments, it is contemplated that the surface equipment package 500/600 includes a controller 550, such as a computer and/or a computerized control system, to monitor and control operation of the surface equipment package 500/600 and the downhole pump. For example, the controller 550 may monitor one or more operating parameters, such as pressure, temperature, and/or flowrate, of fluids in one or more of lines 503, 506, 522, 524, 526, 528, 538, 632, 634, or 636. Additionally, or alternatively, the controller 550 may monitor the linear position of the master piston 512 and/or power fluid piston 517 within the cylinder 518 of the pulsar 510. Additionally, or alternatively, the controller 550 may monitor operating parameters, such as pressure and/or temperature of fluid at the power side 514 of the master piston 512 of the pulsar 510. Additionally, or alternatively, the controller 550 may monitor operating parameters, such as pressure and/or temperature of fluid at the reset side 515 of the master piston 512 of the pulsar 510. Additionally, or alternatively, the controller 550 may monitor operating parameters, such as pressure and/or temperature of fluid in the power fluid chamber 519 of the pulsar 510.

Additionally, or alternatively, the controller 550 may monitor the fluid level in one or more of the main reservoir 502, overflow tank 532, or replenishment reservoir 534. Additionally, or alternatively, the controller 550 may monitor the operation of the master pump 504, and/or transfer pump 536. Additionally, or alternatively, the controller 550 may control the operation of the master pump 504, and/or transfer pump 536. Additionally, or alternatively, the controller 550 may monitor the operation of valve 520, valve 610, valve 620, and/or relief valve 530. Additionally, or alternatively, the controller 550 may control the operation of valve 520, valve 610, valve 620, and/or relief valve 530. Additionally, or alternatively, the controller 550 may monitor one or more operating parameters, such as pressure, temperature, and/or flowrate, of power fluid 28 entering the wellbore 12. Additionally, or alternatively, the controller 550 may monitor one or more operating parameters, such as pressure, temperature, and/or flowrate, of fluid (such as reservoir fluid) being produced from the wellbore 12. Additionally, or alternatively, the controller 550 may monitor the time taken for each production and reset cycle of the downhole pump.

In some embodiments, it is contemplated that the controller 550 can be a computer system including appropriate processing equipment, hardware, storage, and software. The processing equipment, hardware, storage, and software can be located on-site with the surface equipment package 500/600, located remotely from the surface equipment package 500/600, or can include one or more components located on-site with the surface equipment package 500/600 and one or more components located remotely from the surface equipment package 500/600. It is contemplated that any one or more of data processing, data storage, data display, system modeling, system alerting, and/or any other system control function may be conducted locally on-site with the surface equipment package 500/600, at a location remote from the surface equipment package 500/600, or both locally at and remotely from the site of the surface equipment package 500/600.

It is further contemplated that the controller 550 may communicate with an operator, such as an engineer. The operator may be located on-site with the surface equipment package 500/600 and/or at a remote location, such as at a control center. The controller 550 may send data relating to one or more of the monitored parameters described above to the operator. Additionally, or alternatively, the controller 550 may send alarm information relating to one or more of the monitored parameters described above to the operator. For example, alarm information may include (without limitation) a pressure spike, a pressure rise beyond a threshold, a pressure loss beyond a threshold, a linear position of the master piston 512 and/or power fluid piston 517 outside of a threshold range of positions, movement or lack of movement of the master piston 512 and/or power fluid piston 517, movement or lack of movement of a valve, pump and/or pump driver degradation or failure, or any other information concerning a magnitude of an operational parameter that is close to, or exceeds, a prescribed threshold value.

In some embodiments, it is contemplated that the controller 550 may control operation of the surface equipment package 500/600 according to a pre-programmed set of instructions. Additionally, it is contemplated that the controller 550 may receive one or more additional instructions from the operator for the control of one or more items of the surface equipment package 500/600. In an example, the one or more additional instructions may override one or more pre-programmed instructions. An override of one or more pre-programmed instructions may be put into effect temporarily, such as for a selected period of time and/or for a selected number of pump operations. Alternatively, an override of one or more pre-programmed instructions may be put into effect until superseded by a further override.

In some embodiments, it is contemplated that the controller 550 may use a control algorithm to control operation of the surface equipment package 500/600. The control algorithm may be based upon a computer model of the surface equipment package 500/600 and/or the wellbore and downhole pump. Furthermore, the controller 550 may alter the control algorithm. For example, the altering of the control algorithm may be performed reactively in response to a measurement of the one or more parameters described above. In some embodiments, the reactive altering of the control algorithm may be pre-programmed such that a pre-established change in value of a set point of a control parameter (such as pump rate, valve position, etc.) may be initiated. In some embodiments, the reactive altering of the control algorithm may involve first determining a value by which a set point of a control parameter is to be changed, and then initiating the change of the set point. Furthermore, the controller 550 may monitor the effect of altering the control algorithm on the production rate of fluids from the wellbore and/or on the monitored parameters described above.

Additionally, or alternatively, the altering of the control algorithm may be performed proactively. For example, the controller 550 may change a value of a set point of a control parameter without such a change being prompted by a measurement of the one or more parameters described above. Furthermore, the controller 550 may monitor the effect of altering the control algorithm on the production rate of fluids from the wellbore and/or on the monitored parameters described above.

In some embodiments, it is contemplated that the performance of the downhole pump and/or of the surface equipment package 500/600 can be optimized by the altering of the control algorithm reactively and/or proactively. For example, the performance of the downhole pump and/or of the surface equipment package 500/600 can be adjusted in order to increase daily production from the wellbore. Moreover, it is contemplated that the controller 550 may utilize artificial intelligence, including but not limited to machine learning, supervised learning, and/or unsupervised learning, in the altering of the control algorithm. For example, the controller 550 may begin controlling the operation of the surface system 500/600 using an initial control algorithm, and then may alter the control algorithm proactively and/or reactively. Each operation of the surface equipment package 500/600 produces data associated with the particular version of the control algorithm in use at the time that the controller may use as a training data set. The controller 550 may use each new item of data to diagnose performance of the surface equipment package 500/600, diagnose performance of the downhole pump, alter the control algorithm, and/or generate alarms.

In an example, the controller 550 may identify the pressure of the power fluid in the power fluid chamber 519 of the pulsar 510 during a production stroke of the downhole pump increasing over successive cycles. Such a pattern may indicate that the downhole pump is displacing fluid faster than the rate at which reservoir fluid can enter the wellbore from the geological formation (16, FIG. 1). The controller 550 may then alter the control algorithm to decrease the rate at which a production stroke is performed and/or increase a time delay between successive production strokes in order to allow the overall rate of fluid displacement by the downhole pump to become more closely aligned with the rate of fluid influx into the wellbore.

In another example, the controller 550 may detect variations in flow rate of produced fluids and durations of successive production strokes that may indicate that the pistons of the downhole pump are not moving as far on each stroke as the pistons could move (i.e. the downhole pump pistons are not fully stroking). The controller 550 may then alter the control algorithm to change set points of pressure at the power side 514 of the master piston 512 and/or at the reset side 515 of the master piston 512 such that a subsequent stroke of the master piston 512 results in the downhole pump pistons moving a greater distance than on a previous production and/or reset cycle.

In another example, the controller 550 may monitor—directly via gauges or indirectly via surface measurements and a mathematical wellbore model—downhole pressures at and/or within the downhole pump. The controller 550 may also monitor the stroke length of the downhole pump pistons, such as described above. The controller 550 may determine that the data indicates excessive or insufficient power fluid in the combined surface equipment package 500/600 and wellbore system. The controller 550 may initiate a remedial action, such as opening pressure relief valve 530 or activating the transfer pump 536.

In another example, the controller 550 may monitor the run time of selected components of the surface equipment package 500/600, and may establish suitable ranges for monitored parameters and/or service intervals for maintenance of those selected components of the surface equipment package 500/600. The controller 550 may issue alerts and/or alarms concerning the need for maintenance of a component of the surface equipment package 500/600.

In another example, the controller 550 may monitor overall power consumption of the surface equipment package 500/600 and the production rate of fluids from the wellbore. The controller 550 may calculate a cost per unit volume of production. The controller 550 may provide reports indicating the trend of cost per unit volume of production over time, and may provide an alert, or alarm, if the cost per unit volume of production over time approaches or exceeds, respectively, a desired maximum cost per unit volume of production. The controller 550 may alter the control algorithm to adjust the operation of the surface equipment package 500/600 to counteract a rising cost per unit volume of production.

In another example, the controller 550 may monitor operation of the pulsar 510 during one or more cycles. The controller 550 may monitor a pressure at the power side 514 of the master piston 512, a pressure at the reset side 515 of the master piston 512, a pressure of the power fluid 28 in the power fluid chamber 519, and/or a linear position of the master piston 512 and/or power fluid piston 517. The controller 550 may monitor the time taken for completion of one or more cycles. The controller 550 may correlate the pattern(s) of the monitored parameter(s) with the cycle(s) of production from the wellbore. The controller 550 may identify operation inefficiencies in each cycle, such as instances when the master piston 512 and/or power fluid piston 517 is moving, but the downhole pump pistons are not moving. The controller 550 may alter the control algorithm to adjust appropriate set points such that the time taken in moving the master piston 512 and/or power fluid piston 517 without a commensurate movement of the downhole pump pistons is reduced.

Figure 10:
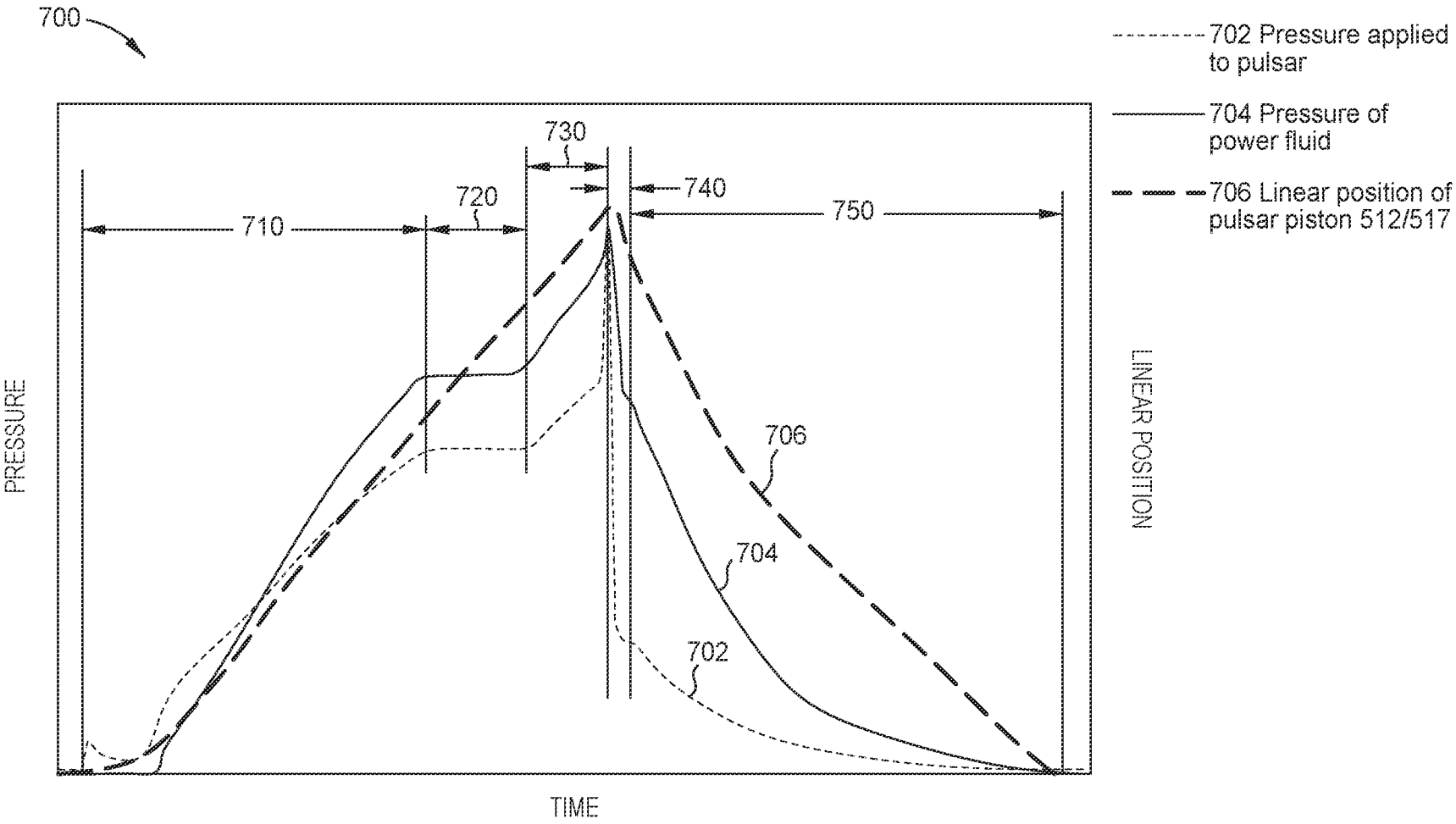
FIG. 10 is a graph illustrating operating parameters during operation of a pump.

The last example above can be further understood by reference to FIG. 10. FIG. 10 presents a graph 700 representative of certain operating parameters during operation of a downhole pump—such as pump 10, pump 200, pump 300, or pump 400—in a wellbore, such as wellbore 12.

The x axis of graph 700 represents time, the left-hand y axis of graph 700 represents pressure, and the right-hand y axis of graph 700 represents a linear position of a pulsar piston, such as master piston 512 or power fluid piston 517 of pulsar 510. The values of selected operating parameters are plotted as lines on the graph 700. As an example, based on surface equipment package 500 or 600 operating with any of pumps 10, 200, 300, or 400 in a wellbore 12, line 702 represents a pressure applied to the power side 514 of master piston 512 of pulsar 510, and is plotted with respect to the left-hand y axis of graph 700. Line 704 represents the pressure of the power fluid 28 routed to the wellhead 36, and is plotted with respect to the left-hand y axis of graph 700. Line 706 represents a linear position of the master piston 512 and/or power fluid piston 517 within cylinder 518, and is plotted with respect to the right-hand y axis of graph 700.

The graph 700 is divided into several regions to illustrate the behavior of the selected parameters during a typical operation cycle of a power stroke followed by a reset stroke. In region 710, the pressure 702 applied to the power side 514 of master piston 512 increases, and the master piston 512 moves through the cylinder 518. The pressure 704 of the power fluid 28 increases accordingly, indicating that the pistons (such as pistons 70, 88, 106) of the downhole pump are stationary, or are moving by only a small fraction (e.g.

5% or less) of their respective strokes. In region 710, the predominant action is compression of the power fluid 28 in the wellbore 12.

In region 720, master pump 504 continues to feed fluid to the power side 514 of the master piston 512, and the master piston 512 continues to move through the cylinder 518, but the pressure 702 applied to the power side 514 of master piston 512 remains relatively constant. The pressure 704 of the power fluid 28 also remains relatively constant. Such a pattern indicates that the pistons of the downhole pump are moving in a production stroke. In region 720, the predominant action is the production stroke of the downhole pump.

In region 730, master pump 504 continues to feed fluid to the power side 514 of the master piston 512, and the master piston 512 continues to move through the cylinder 518. The pressure 702 applied to the power side 514 of master piston 512 and the pressure 704 of the power fluid 28 both increase accordingly, indicating that the pistons of the downhole pump are stationary. In region 730, the predominant action is a secondary compression of the power fluid 28 in the wellbore. At the end of region 730, the pressure 702 applied to the power side 514 of master piston 512 spikes and the linear position 706 of the master piston 512 is constant, indicating that the master piston 512 has reached the end of possible travel through the cylinder 518. At this point, the surface equipment package 500/600 switches to perform a reset stroke of the downhole pump.

When the surface equipment package 500/600 switches to perform a reset stroke of the downhole pump, the master pump 504 no longer feeds fluid to the power side 514 of the master piston 512, and the pressure 702 at the power side 514 of master piston 512 is bled off. Hence, the graph 700 shows a rapid decline in pressure 702 at the power side 514 of master piston 512 at the beginning of region 740. In region 740, the master piston 512 moves in reverse through the cylinder 518, and the pressure 704 of the power fluid 28 experiences a commensurate rapid decline. Such a pattern indicates that the pistons of the downhole pump are moving in a reset stroke. At the end of region 740, the pressure 704 of the power fluid 28 experiences a plateau, indicating that the pistons in the downhole pump have reached the end of their respective reset strokes. In region 740, the predominant action is the reset stroke.

In region 750, the pressure 702 applied to the power side 514 of master piston 512 decreases, and the master piston 512 continues to move in reverse through the cylinder 518. The pressure 704 of the power fluid 28 decreases accordingly. Such a pattern indicates that the predominant action is the reset stroke of the master piston, even though the pistons in the downhole pump have reached the end of their respective reset strokes.

In regions 710 and 750, the master piston 512 of pulsar 510 is moving for a significant portion of time, whereas the pistons in the downhole pump are stationary. In an example, the total time for a full cycle from the beginning of region 710 to the end of region 750 is approximately two-and-a-half minutes, of which more than one-and-a-half minutes involves moving the master piston 512 of pulsar 510 without moving the pistons of the downhole pump. In such an example, approximately 60% of the cycle time is wasted by moving the master piston 512 of pulsar 510 without moving the pistons of the downhole pump. In other examples, 30% or more, 40% or more, 50% or more, 60% or more, 70% or more, or 80% or more of the cycle time is wasted by moving the master piston 512 of pulsar 510 without moving the pistons of the downhole pump.

In an example operation, the controller 550 may alter the control algorithm so that the power fluid 28 in the wellbore and in line 524 remains at least partially pressurized at the end of a reset stroke of the downhole pump. For example, the controller 550 may alter the control algorithm to limit the movement of the master piston 512 during a reset stroke, such as by closing a valve at the inlet to the pulsar 510 at the power side 514 of the master piston 512. Additionally, or alternatively, the controller 550 may activate a mechanical stop at the pulsar 510 in order to hinder or otherwise limit the travel of the master piston 512.

In another example, at the beginning of a production stroke of the downhole pump, the controller 550 may alter the control algorithm to adjust valve 520, or valve 610 and valve 620, so that the power fluid 28 in the wellbore and line 524 becomes pressurized by routing fluid from the main reservoir 502 via the bypass line 526 into line 524. The controller 550 registers or estimates the threshold pressure of power fluid 28 at which the pistons in the downhole pump begin to move in a production stroke. Upon the pressure 704 of power fluid 28 reaching a value that is (for example) 90% to 100% of the threshold pressure, the controller 550 may activate valve 520, or valve 610 and valve 620, to close access to the bypass line 526, and route fluid to the pulsar 510 via line 522. In this way, the production stroke of the pistons in the downhole pump may be monitored at least in part by observing the linear displacement of the master piston 512 and/or power fluid piston 517.

In the above example, the time taken to pressurize the power fluid 28 in line 524 and operate a production stroke of the downhole pump may be less than the time taken to operate a production stroke of the downhole pump via application of pressure on the power fluid 28 in line 524 from the pulsar 510 only. In other words, a portion of the time depicted in region 710 of graph 700 for conventional operation of a downhole pump may be eliminated. For instance, the time saved may be 30 seconds or more, 60 seconds or more, 90 seconds or more, 120 seconds or more, 150 seconds or more, or 180 seconds or more. Additionally, or alternatively, the time saved—expressed as a percentage of the time depicted in region 710 of graph 700 for conventional operation of a downhole pump—may be 30% or more, 40% or more, 50% or more, 60% or more, 70% or more, or 80% or more.

The apparatus and methods of the present disclosure, including the foregoing examples, provide for a robust and adaptable pumping system suited to shallow wells, deep wells, vertical wells, deviated wells, and horizontal wells. The apparatus and methods of the present disclosure, including the foregoing examples, provide for a pumping system that facilitates chemical treatments of wellbore equipment and of the fluids in a wellbore. The apparatus and methods of the present disclosure, including the foregoing examples, provide for a pumping system that facilitates the remedy of gas-locking in a downhole pump. The apparatus and methods of the present disclosure, including the foregoing examples, provide for a pumping system that facilitates the optimization of pumping rates and equipment operating regimes and parameters.

While the foregoing is directed to embodiments of the present disclosure, other and further embodiments of the disclosure may be devised without departing from the basic scope thereof, and the scope thereof is determined by the claims that follow.

What is claimed is:

1. A pump comprising:

a drive chamber;

a production chamber having a fluid inlet configured to permit entry of fluids external to the pump into the production chamber;

a piston assembly comprising a drive piston axially movable within the drive chamber, and coupled to a production piston by a tube, the production piston axially movable within the production chamber by movement of the drive piston and the tube;

a passage in fluidic communication with a first side of the drive piston; and a port fluidically coupling the passage with the production chamber;

wherein the tube fluidically couples the production chamber and the passage with a second side of the drive piston.

2. The pump of claim 1, further comprising a valve in fluidic communication with the port.

3. The pump of claim 2, wherein the valve is configured to allow a seepage of fluid through the port.

4. The pump of claim 2, wherein the valve permits fluid flow into the production chamber through the port, and inhibits fluid flow out of the production chamber through the port.

5. The pump of claim 4, wherein the valve is configured to open when a differential pressure across the valve reaches a first threshold value.

6. The pump of claim 5, wherein the valve is configured to close when the differential pressure across the valve reaches a second threshold value lower than the first threshold value.

7. A method of operating a pump in a wellbore, comprising:

applying a first pressure to a fluid in a passage of the pump, thereby moving a drive piston in a first direction within a drive chamber and moving a production piston in the first direction within a production chamber, wherein:

the passage is in fluidic communication with a first side of the drive piston;

the production piston is coupled to the drive piston by a tube, and is moved in the first direction by movement of the drive piston and the tube; and the production chamber has a fluid inlet configured to permit entry of fluids external to the pump into the production chamber;

then applying a second pressure to the fluid in the passage, the second pressure greater than the first pressure; and injecting the fluid from the passage into the production chamber through a port;

wherein the tube fluidically couples the production chamber and the passage with a second side of the drive piston.

8. The method of claim 7, wherein applying the second pressure to the fluid opens a valve in the port.

9. The method of claim 8, wherein the fluid injected through the port displaces gas in the production chamber.

10. The method of claim 9, further comprising pressurizing the gas by injecting the fluid into the production chamber.

11. The method of claim 10, further comprising causing the gas to flow through the tube coupling the drive piston with the production piston.

12. The method of claim 8, further comprising reducing pressure applied to the fluid, thereby closing the valve.

13. A pump comprising:

a housing including:

a first connection configured to couple to a first fluid conduit; and a second connection configured to couple to a second fluid conduit;

a drive chamber in the housing;

a production chamber in the housing having a fluid inlet configured to permit entry of fluids external to the pump into the production chamber;

a piston assembly comprising a drive piston axially movable within the drive chamber, and coupled to a production piston by a tube, the production piston axially movable within the production chamber by movement of the drive piston and the tube;

a passage in fluidic communication with the first connection and with a first side of the drive piston; and a port fluidically coupling the passage with the production chamber;

wherein the tube fluidically couples the production chamber and the passage with a second side of the drive piston and the second connection.

14. The pump of claim 13, further comprising a valve in fluidic communication with the port.

15. The pump of claim 14, wherein the valve is configured to allow a seepage of fluid through the port.

16. The pump of claim 14, wherein the valve permits the flow of fluid into the production chamber through the port, and inhibits the flow of fluid out of the production chamber through the port.

17. The pump of claim 16, wherein the valve is configured to open when a differential pressure across the valve reaches a first threshold value.

18. The pump of claim 17, wherein the valve is configured to close when the differential pressure across the valve reaches a second threshold value lower than the first threshold value.

* * * * *